US007567769B2

(12) United States Patent
Noguchi et al.

(10) Patent No.: US 7,567,769 B2
(45) Date of Patent: Jul. 28, 2009

(54) ELECTROPHOTOGRAPHIC COLOR IMAGE FORMING APPARATUS

(75) Inventors: Tomio Noguchi, Shizuoka-ken (JP); Hiromi Sakurai, Susono (JP); Chikara Imaizumi, Numazu (JP); Takeo Kawanami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 11/624,024

(22) Filed: Jan. 17, 2007

(65) Prior Publication Data

US 2008/0159781 A1 Jul. 3, 2008

(30) Foreign Application Priority Data

Dec. 28, 2006 (JP) ..... 2006-355652

(51) Int. Cl.
*G03G 15/00* (2006.01)
*G03G 21/16* (2006.01)

(52) U.S. Cl. ..... 399/110; 399/112

(58) Field of Classification Search ..... 399/110, 399/111, 112
See application file for complete search history.

(56) References Cited

U.S. PATENT DOCUMENTS

| | | | | |
|---|---|---|---|---|
| 7,127,194 | B2 | 10/2006 | Hoshi et al. | 399/111 |
| 7,349,649 | B2 | 3/2008 | Hoshi et al. | 399/111 |
| 2006/0140674 | A1 | 6/2006 | Sato | 399/119 |
| 2007/0071482 | A1 * | 3/2007 | Okabe | 399/111 X |
| 2007/0071494 | A1 * | 3/2007 | Igarashi et al. | 399/110 |
| 2007/0160380 | A1 | 7/2007 | Imaizumi et al. | 399/90 |
| 2007/0160384 | A1 | 7/2007 | Sakurai et al. | 399/110 |
| 2007/0160385 | A1 | 7/2007 | Noguchi et al. | 399/110 |
| 2007/0160388 | A1 * | 7/2007 | Yoshimura et al. | 399/111 |
| 2008/0159772 | A1 * | 7/2008 | Koishi et al. | 399/111 X |
| 2008/0159773 | A1 * | 7/2008 | Murayama et al. | 399/110 X |
| 2008/0159775 | A1 * | 7/2008 | Koishi et al. | 399/111 X |

FOREIGN PATENT DOCUMENTS

| | | |
|---|---|---|
| JP | 2000-132069 | 5/2000 |
| JP | 2003-255660 | 9/2003 |
| JP | 2004-258440 | 9/2004 |
| JP | 2005-70085 | 3/2005 |
| JP | 2006-184553 | 7/2006 |
| KR | 10-2005-0022859 | 3/2005 |

OTHER PUBLICATIONS

Korean Office Action dated Aug. 21, 2008.

* cited by examiner

*Primary Examiner*—Sophia S Chen
(74) *Attorney, Agent, or Firm*—Fitzpatrick, Cella, Harper & Scinto

(57) ABSTRACT

A color electrophotographic image forming apparatus has a main assembly, to which a process cartridge is detachably mountable, for forming a color image on a recording material. The process cartridge includes an electrophotographic photosensitive drum and a process device actable on the electrophotographic photosensitive drum. The apparatus includes an opening provided in the main assembly of the apparatus, a movable member which is linearly movable between an inside and an outside of the opening in a direction crossing with a longitudinal direction of the electrophotographic photosensitive drum while carrying plurality of such process cartridges, an accommodating portion for accommodating the process cartridges and an urging member, provided above a movement path of the process cartridges, while being carried on the movable member, from the opening to the accommodating portion, for contacting the process cartridge passing therebelow to urge the process cartridge toward the movable member.

11 Claims, 18 Drawing Sheets

ELECTROPHOTOGRAPHIC COLOR IMAGE FORMING APPARATUS

FIELD OF THE INVENTION AND RELATED ART

The present invention relates to an electrophotographic color image forming apparatus which employs a process cartridge (or cartridges) removably mountable in the main assembly thereof.

As examples of an electrophotographic color image forming apparatus, there are an electrophotographic color copying machine, an electrophotographic color printer (a color laser printer, a color LED printer, etc.), etc.

The term "process cartridge" means a cartridge in which an electrophotographic photosensitive member, and one or more processing means for processing the electrophotographic photosensitive member, are integrally disposed so that they can be removably mountable in the main assembly of the image forming apparatus. More specifically, a process cartridge is a cartridge in which an electrophotographic photosensitive member, and at least one among the abovementioned processing members, such as a developing means, a charging means, and a cleaning means, are integrally disposed.

A process cartridge is removably mountable in the main assembly of an image forming apparatus by a user himself. Therefore, a process cartridge makes it possible for a user to maintain an image forming apparatus without relying on service personnel.

There have been known various structural arrangements for accurately positioning a process cartridge relative to the main assembly of an electrophotographic image forming apparatus.

For example, the apparatus main assembly is provided with pressure application springs, which are disposed along the cartridge guiding surface of the main assembly. Each of these springs is fitted around a spring supporting member, and is wound so that it applies pressure to the dowel with which a process cartridge is provided.

This structural arrangement prevents a cartridge from rotating when it receives a rotational driving force from the main assembly of an image forming apparatus (Japanese Laid-open Patent Application 2000-132069 (FIGS. 14 and 15; Page 8, right column, lines 1-11).

According to this structural arrangement, it is possible to precisely position a cartridge relative to the apparatus main assembly when forming an image.

In recent years, in the field of an electrophotographic color image forming apparatus, it has been thought of structuring an image forming apparatus so that multiple process cartridges are supported in a movable member which is movable relative to the apparatus main assembly. This structural arrangement makes it possible to insert all at once multiple cartridges in the main assembly of an image forming apparatus by pushing the abovementioned movable member into the apparatus main assembly.

The present invention is a further development of the above described structural arrangement in accordance with the prior art.

SUMMARY OF THE INVENTION

The primary object of the present invention is to provide an electrophotographic color image forming apparatus structured so that multiple process cartridges can be smoothly inserted into its main assembly.

Another object of the present invention is to provide an electrophotographic image forming apparatus which is substantially superior in operability to an electrophotographic color image forming apparatus in accordance with the prior art, in terms of the insertion of multiple cartridges into the apparatus main assembly.

Another object of the present invention is to provide an electrophotographic color image forming apparatus which employs a cartridge-holding movable member which can be pulled out of its main assembly or retracted into the main assembly; and which is characterized in that when the movable member is retracted into the main assembly while holding multiple process cartridges, the cartridges do not accidentally collide with the other structural components of the main assembly.

Another object of the present invention is to provide an electrophotographic color image forming apparatus which employs a cartridge-holding movable member which can be pulled out of its main assembly or retracted into the main assembly; and which is characterized in that even if a cartridge or cartridges are upwardly deviated from the cartridge-holding movable member, they are moved by a pressing member into the correct cartridge supporting position in the cartridge-holding movable member.

Another object of the present invention is to provide an electrophotographic color image forming apparatus which employs a cartridge-holding movable member and a cartridge pressing member; and which is characterized in that the cartridge pressing member is disposed in the top portion of the path of the cartridge-holding movable member so that when multiple cartridges are moved through the space (the path of cartridge-holding movable member) under the cartridge pressing member, the cartridges are pressed down by the pressure applied by the elastic pressing members.

According to an aspect of the present invention, there is provided a color electrophotographic image forming apparatus having a main assembly, to which a process cartridge is detachably mountable, for forming a color image on a recording material. The process cartridge includes an electrophotographic photosensitive drum and process means actable on the electrophotographic photosensitive drum, the apparatus comprising an opening provided in the main assembly of the apparatus; a movable member which is linearly movable between an inside and an outside of the opening in a direction crossing with a longitudinal direction of the electrophotographic photosensitive drum while carrying plurality of such process cartridges; an accommodating portion for accommodating the process cartridges; and an urging member, provided above a movement path of the process cartridges, while being carried on the movable member, from the opening to the accommodating portion, for contacting the process cartridge passing therebelow to urge the process cartridge toward the movable member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

General Structure of Image Forming Apparatus

Figure 1:
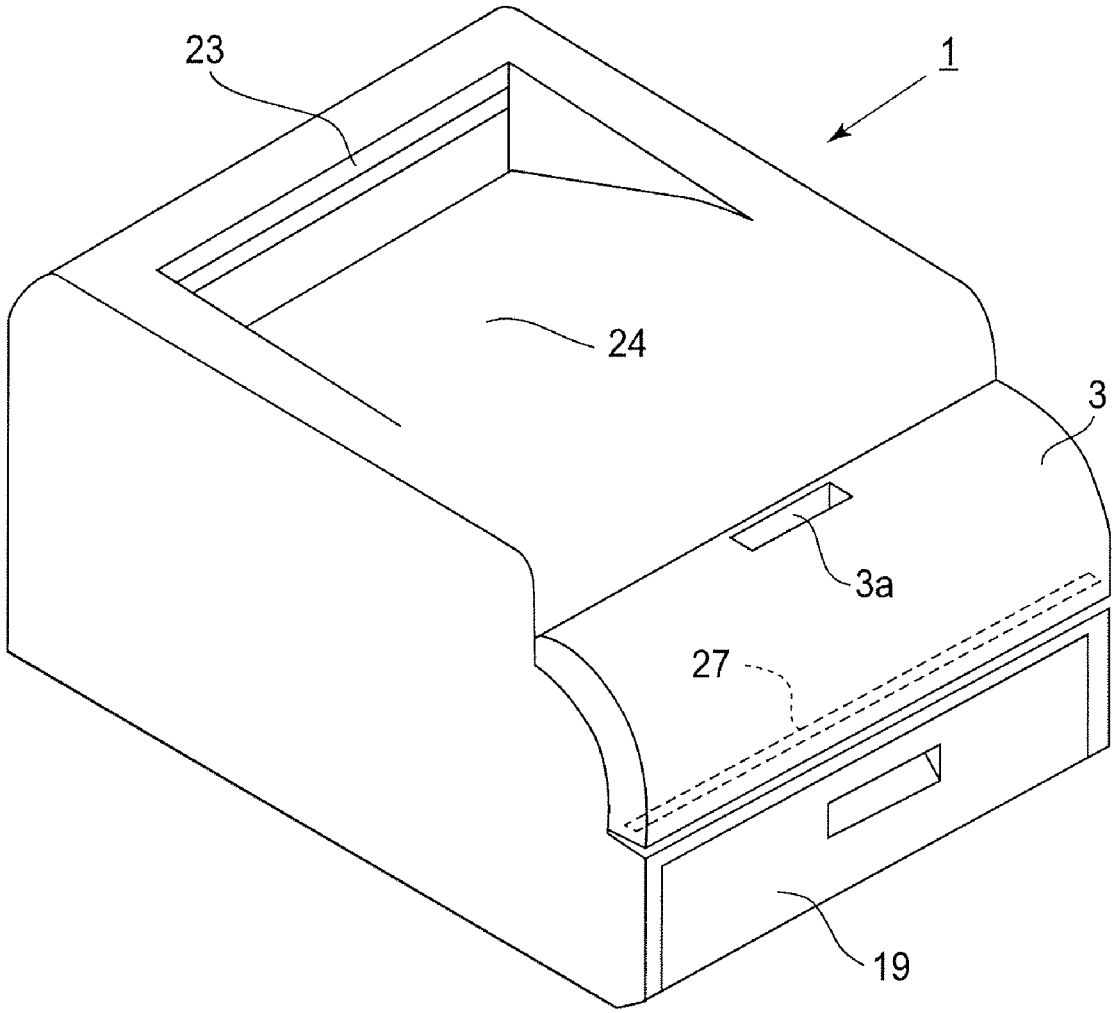
FIG. 1 is an external perspective view of the image forming apparatus in one of the preferred embodiment of the present invention.
Figure 2:
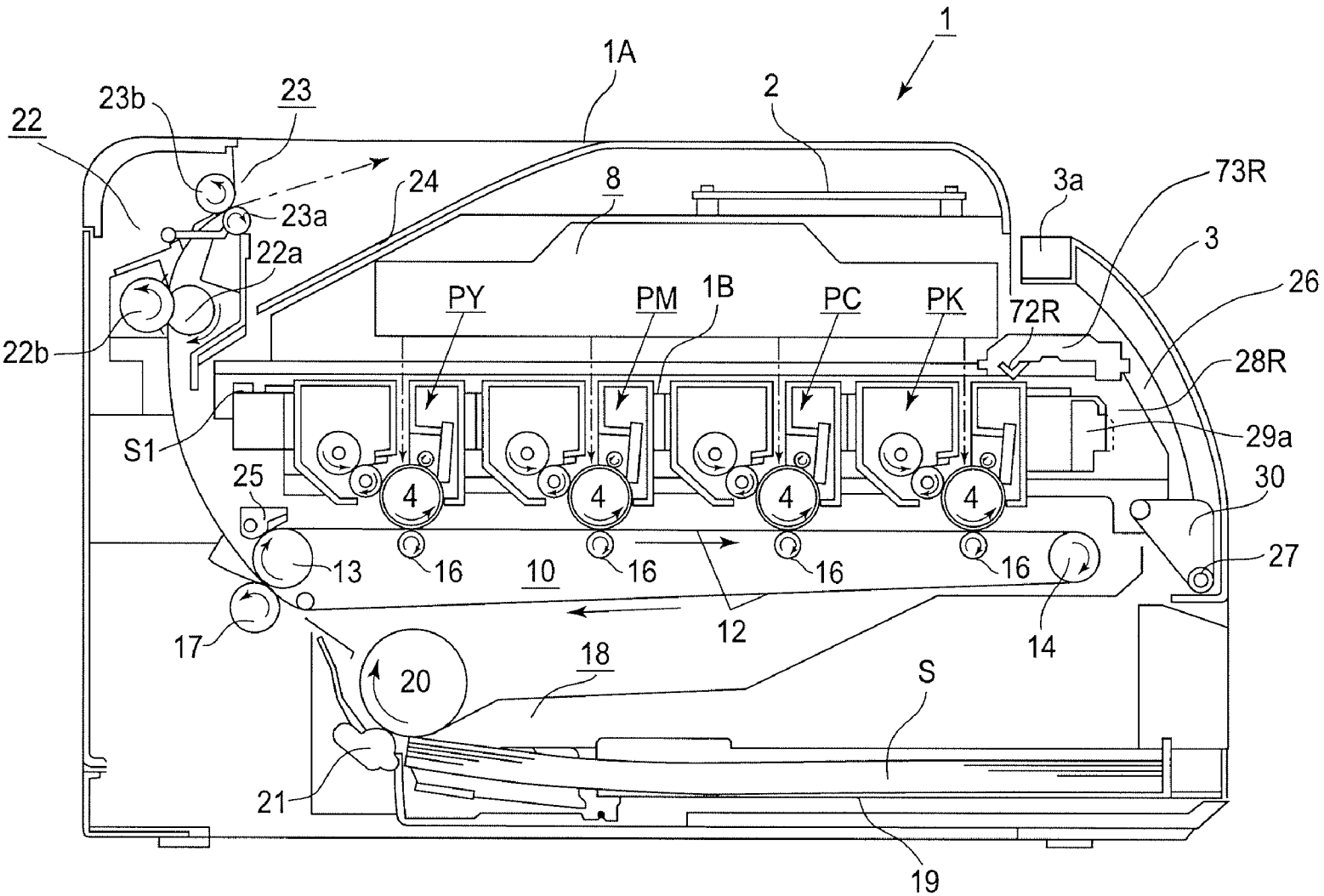
FIG. 2 is a vertical sectional view of the image forming apparatus shown in FIG. 1, as seen from the left side of the apparatus.
Figure 3:
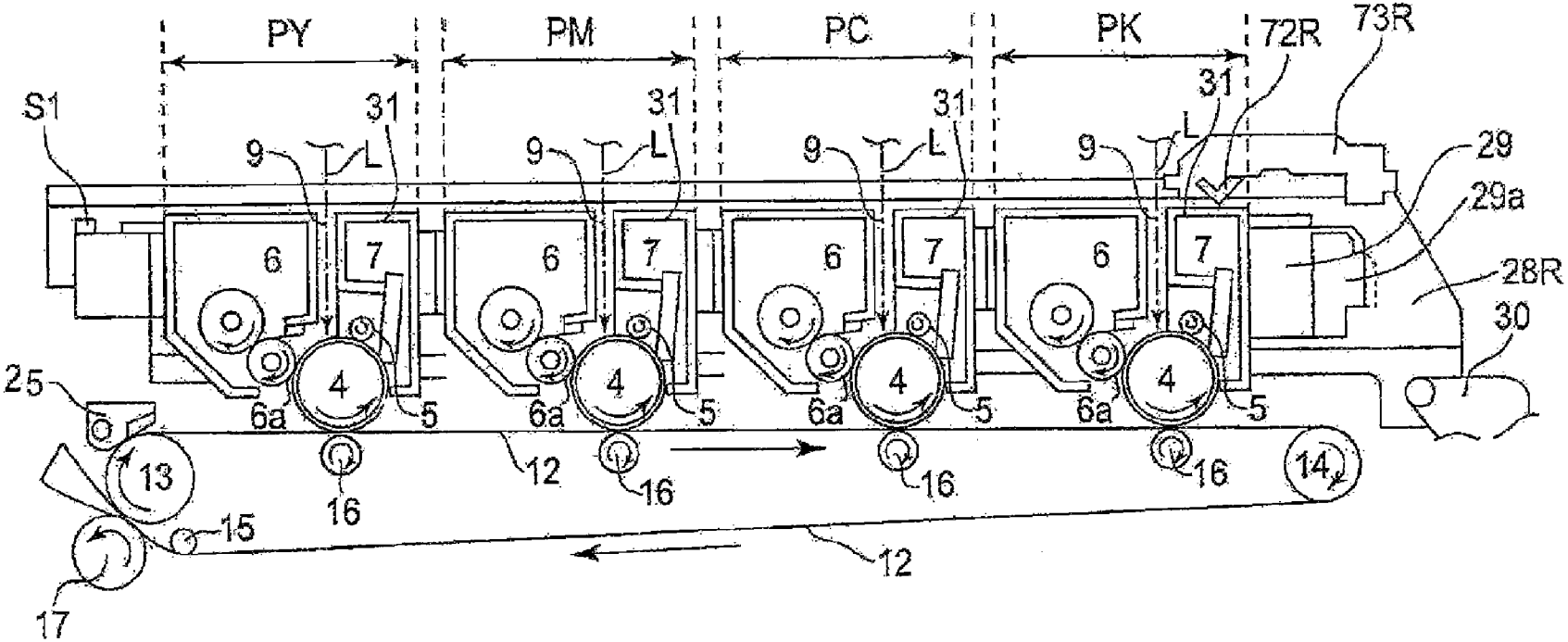
FIG. 3 is an enlargement of a part of FIG. 2.

FIG. 1 is an external perspective view of the image forming in this embodiment, and FIG. 2 is a vertical sectional view of the image forming apparatus, as seen from the left side of the apparatus. FIG. 3 is an enlargement of a part of FIG. 2.

This image forming apparatus 1 is a full-color laser printer based on four primary colors. It uses an electrophotographic process. It forms an image on a recording medium S (for example, recording paper, an OHP sheet, a label, etc.) in response to electrical picture signals inputted from an external host apparatus (unshown), such as a personal computer, an image reader, etc. That is, the image forming apparatus 1 is an apparatus structured so that cartridges are removably mountable in its main assembly 1A to form a color image on the recording medium S.

In the following description of the preferred embodiment of the present invention, the front side (front surface side) of the image forming apparatus is the side which has a door 3. The rear side of the image forming apparatus is the side opposite to the front side. "Fore-and-after direction" includes both the frontward and rearward directions. "The left and right sides of the apparatus main assembly" is the left and right sides of the apparatus main assembly as seen from the front side of the apparatus main assembly. The "side to side direction" includes both the leftward and rightward directions.

The lengthwise end of a photosensitive drum (end of a photosensitive drum in terms of direction parallel to its axis), from which the photosensitive drum is driven, will be referred to as driven side, and the lengthwise end opposite thereto will be referred to as non-driven side.

Designated by a reference character 1B is a cartridge chamber, which is in the main assembly 1A of the image forming apparatus 1. There are four process cartridges (first to fourth), that is, cartridges PY, PM, PC, and PK, in the cartridge chamber 1B. The four cartridges PY, PM, PC, and PK are horizontally arranged in the listed order in the rear-to-front direction of the apparatus main assembly 1A (which may be referred to as inline or tandem arrangement). The four cartridges are the same in structure, although they are different in the color of the developers they store. The cartridge chamber 1B is a chamber into which multiple cartridges are installed while being held in cartridge tray. To each cartridge in this chamber 1B, a rotational driving force is transmitted from the apparatus main assembly 1A, as will be described later in detail. Further, to each cartridge in this chamber 1B, a bias is supplied from the apparatus main assembly 1A.

Each cartridge in this embodiment has: an electrophotographic photosensitive drum 4 (which hereafter will be referred to as drum); and a drum unit 31 (first unit) made up of processing means, more specifically, a charging means 5 and a cleaning means 7, which performs a cleaning process on the drum 4. Further, each cartridge has a development unit 6 (second unit) having a developing means as a processing means. The abovementioned drum and development units 31 and 6, respectively, are joined so that they are allowed to rotationally move relative to each other. As the charging means 5, a charge roller is used. As the cleaning means 7, a cleaning blade is used. As a developing means, a development roller 6*a* is used.

The developer container of the first cartridge PY stores yellow (Y) developer. On the peripheral surface of the drum 4, a developer image of yellow (Y) color is formed. The developer container of the second cartridge PM stores magenta (M) developer. On the peripheral surface of the drum 4, a developer image of magenta (M) color is formed. The developer container of the third cartridge PC stores cyan (C) developer. On the peripheral surface of the drum 4, a developer image of cyan (C) color is formed. The developer container of the fourth cartridge PK stores black (K) developer. On the peripheral surface of the drum 4, a developer image of black (K) color is formed.

In the area above the cartridges PY, PM, PC, and PK, a laser scanner unit 8 is disposed. This scanner unit 8 exposes the peripheral surface of the drum 4 in each cartridge. That is, the picture information regarding the image to be formed by each cartridge is inputted into the control circuit 2 from the external host apparatus (unshown), and the scanner unit 8 outputs a beam of laser light L while modulating it with the picture information, so that the peripheral surface of the photosensitive drum 4 in each cartridge is scanned (exposed) by the beam of laser light L through the exposure window 9, with which the top wall of the cartridge is provided.

In the area below the cartridge PY, PM, PC, and PK, an intermediary transfer belt unit 10, as a transferring member, is disposed, which has a flexible endless belt 12 (transfer belt), a driver roller 13, a turn roller 14, and tension roller 15. The endless belt 12 is stretched around the driver roller 13, the turn roller 14, and the tension roller 15, being thereby suspended by them, so that it can be circularly driven. The driver roller 13 and the tension roller 15 are disposed in the rear portion of the apparatus main assembly 1A, whereas the turn roller 14 is disposed in the front portion of the apparatus main assembly 1A. Each cartridge is disposed so that the downwardly facing portion of the peripheral surface of the drum 4 remains in contact with the upwardly facing portion of the external surface of the endless belt 12 (primary transfer nip). On the inward side of the loop, which the belt 12 forms, primary transfer rollers 16 are disposed. Each transfer roller 16 is disposed so that it opposes the drum 4 in the corresponding cartridge, with the portion of the endless belt 12, which corresponds to the top portion of the loop, pinched between the transfer roller 16 and drum 4. A secondary transfer roller 17 is disposed outside the belt loop so that it opposes the driver roller 13, with the belt 12 pinched between the two rollers.

In the area below the belt unit 10, a paper feeder unit 18 is disposed, which has a tray 19, a paper feeder roller 20, a paper separation pad 21, etc. The tray 19 is removably mountable in the apparatus main assembly 1A from the front side (front loading).

In the top portion of the rear portion of the apparatus main assembly 1A, a fixation unit 22 and a paper discharging unit 23 are disposed. Further, the top wall of the apparatus main assembly 1A is shaped so that a part of the wall is utilized as a delivery tray 24. The fixation unit 22 has a fixation film assembly 22*a* and a pressure application roller 22*b*. The paper discharging unit 23 has rollers 23*a* and 23*b*.

Each cartridge in the cartridge chamber 1B is under the pressure applied from above by a pressure application mechanism (unshown), being thereby correctly positioned relative to the cartridge positioning portion (unshown) of the apparatus main assembly, and also, being thereby securely held to the apparatus main assembly. The driving force input portion of the cartridge is engaged with the driving force output portion of the apparatus main assembly. Further, the input electrical contact of the cartridge is connected to the power supply system with which the apparatus main assembly 1A is provided. This structural arrangement will be described later in more detail.

The operation carried out by this image forming apparatus to form a full-color image is as follow: The drum 4 in each of the first to fourth cartridges PY, PM, PC, and PK is rotationally driven at a preset velocity in the counterclockwise direction indicated by an arrow mark. Further, the belt 12 is circularly driven in the clockwise direction indicated by an arrow mark (subordinate direction to rotational direction of photosensitive drum) at a velocity which corresponds to the peripheral velocity of the drum 4. The scanner unit 8 is also driven. In synchronization with the driving of the scanner unit 8, the charge roller 5 in each cartridge uniformly charges the peripheral surface of the drum 4 to preset polarity and potential, with a preset (controlled) timing. The scanner unit 8 scans (exposes) the peripheral surface of each drum 4 with the beam of laser light L while modulating the beam of laser light L with the picture signals for forming an monochromatic image of the primary color assigned to each cartridge. As a result, an electrostatic latent image, which reflects the picture signals corresponding to the primary color assigned to the cartridge, is effected on the peripheral surface of the drum 4. This electrostatic latent image is developed by the development roller 6*a*.

Through the above described electrophotographic image formation process, a yellow developer image, which corresponds to the yellow color component of an intended full-color image is formed on the drum 4 of the first cartridge PY. This yellow developer image is transferred (primary transfer) onto the belt 12.

On the drum 4 of the second cartridge PM, a magenta developer image, which corresponds to the magenta color component of the full-color image is formed, and this developer image is transferred (primary transfer) onto the belt 12 so that it is layered on the yellow developer image which is already on the belt 12.

On the drum 4 of the third cartridge PC, a cyan developer image, which corresponds to the cyan color component of the full-color image is formed, and this developer image is transferred (primary transfer) onto the belt 12 so that it is layered on the yellow and magenta developer images which are already on the belt 12.

On the drum 4 of the fourth cartridge PK, a black developer image, which corresponds to the black color component of the full-color image is formed, and this developer image is transferred (primary transfer) onto the belt 12 so that it is layered on the yellow, magenta, and cyan developer images which are already on the belt 12.

Consequently, an unfixed full-color developer image is effected on the belt 12 by the four monochromatic color developer images, that is, the yellow, magenta, cyan, and black color development images.

After the primary transfer of the developer image onto the belt 12, the toner remaining on the peripheral surface of the drum 4 in each cartridge is removed by the cleaning means 7.

Meanwhile, the paper feeder roller 20 is driven with the preset (controlled) timing. As the paper feeder roller 20 is driven, one of the sheets of the recording medium S stacked in the tray 19 is separated from the rest of the sheets of the recording medium by the coordination of the sheet feeder roller 20 and the separation pad 21, and is fed into the apparatus main assembly 1A by the sheet feeder roller 20. The recording medium S is introduced into the nip (secondary transfer nip), that is, the interface between the secondary transfer roller 17 and the belt 12, and then, is conveyed through the nip while remaining pinched by the secondary transfer roller 17 and the belt 12. While the recording medium S is conveyed through the nip, the four layers of developer images, different in color, on the belt 12 are transferred together onto the recording medium S as if they were peeled away from the belt 12, starting at their leading edges.

The recording medium S is separated from the surface of the belt 12, and is introduced into the fixation unit 22, and is subjected to heat and pressure in the fixation nip of the fixation unit 22. As a result, the four layers of developer images different in color are fixed to the recording medium S. Thereafter, the recording medium S is moved out of the fixation unit 22, and then, is discharged as a full-color copy onto the delivery tray 24 by the paper discharging unit 23.

After the separation of the recording medium S from the belt 12, the secondary transfer residual developer, that is, the developer remaining on the surface of the belt 12 after the separation of the recording medium S from the belt 12, is removed by a belt cleaning device 25.

(Method for Replacing Cartridge)

As an image forming operation is carried out by each of the first to fourth cartridges PY, PM, PC, and PK, the developer stored in the development unit 6 of each cartridge is consumed.

Thus, the image forming apparatus is provided with a means (unshown) for detecting the amount of the developer remaining in each cartridge. The detected amount of the developer in each cartridge is compared, by the control circuit portion of the apparatus main assembly 1A, with a threshold value preset for issuing a warning to indicate that the cartridge is near the end of its service life, or that the cartridge has reached the end of its service life. If the detected amount of the residual developer in the cartridge is smaller than the preset threshold value, the message which warns the user that the cartridge is close to the end of its life or has reached the end of its life is displayed on the screen of the monitor portion (unshown); in other words, the image forming apparatus prompts the user to prepare a replacement cartridge, or to replace the cartridge, in order to maintain a preset level of image quality.

In order to improve the image forming apparatus in usability, the image forming apparatus in this embodiment is provided with a cartridge tray (movable member which is movable while holding cartridges), which can be pulled out frontward to make it easier for a user to access the cartridges from the front side of the apparatus, in order to replace the cartridge.

When the cartridge tray is in the most outward position relative to the apparatus main assembly 1A, all the cartridges in the tray are outside the apparatus main assembly 1A, making it easier for the user to replace any cartridge in the tray.

More specifically, the front wall of the image forming apparatus 1 is provided with an opening 26, through which the cartridge can be inserted into, or removed from, the apparatus main assembly 1A. That is, the apparatus main assembly 1A has the opening 26, through which the cartridge is allowed to pass.

Further, the apparatus main assembly 1A is provided with a door 3, which can be rotationally moved between the closed position in which it covers the opening 26, and the open position in which it exposes the opening 26 and which contains an indentation 3*a*.

Figure 4:
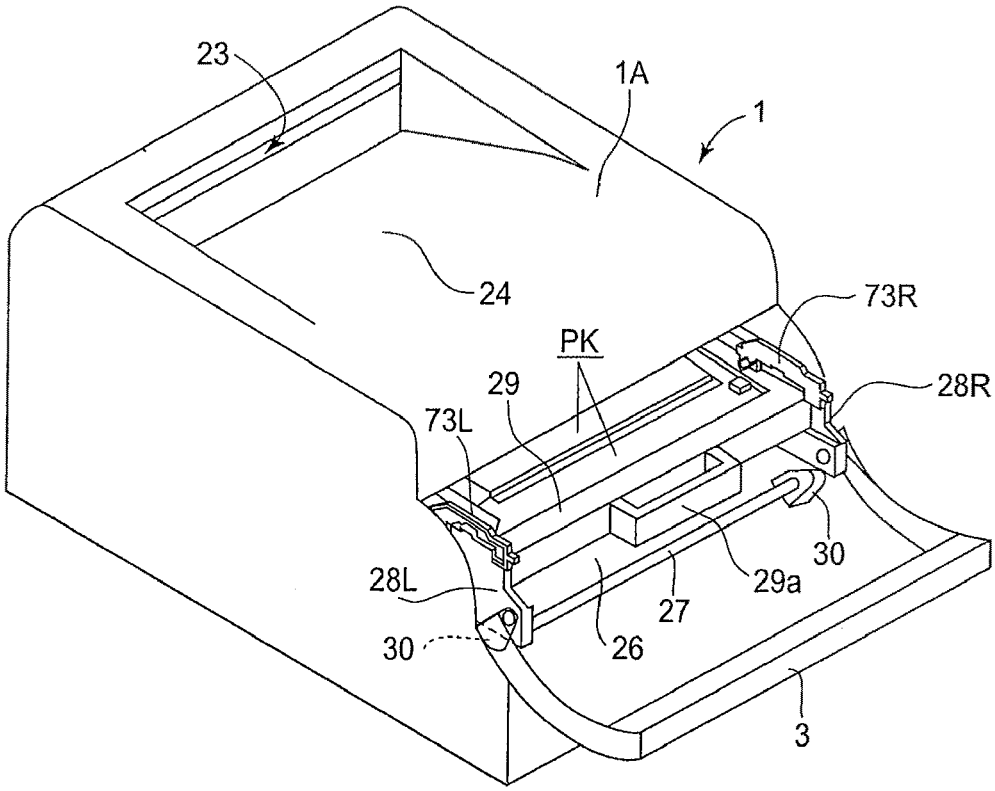
FIG. 4 is an external perspective view of the image forming apparatus, shown in FIG. 1, the door of which is open.
Figure 5:
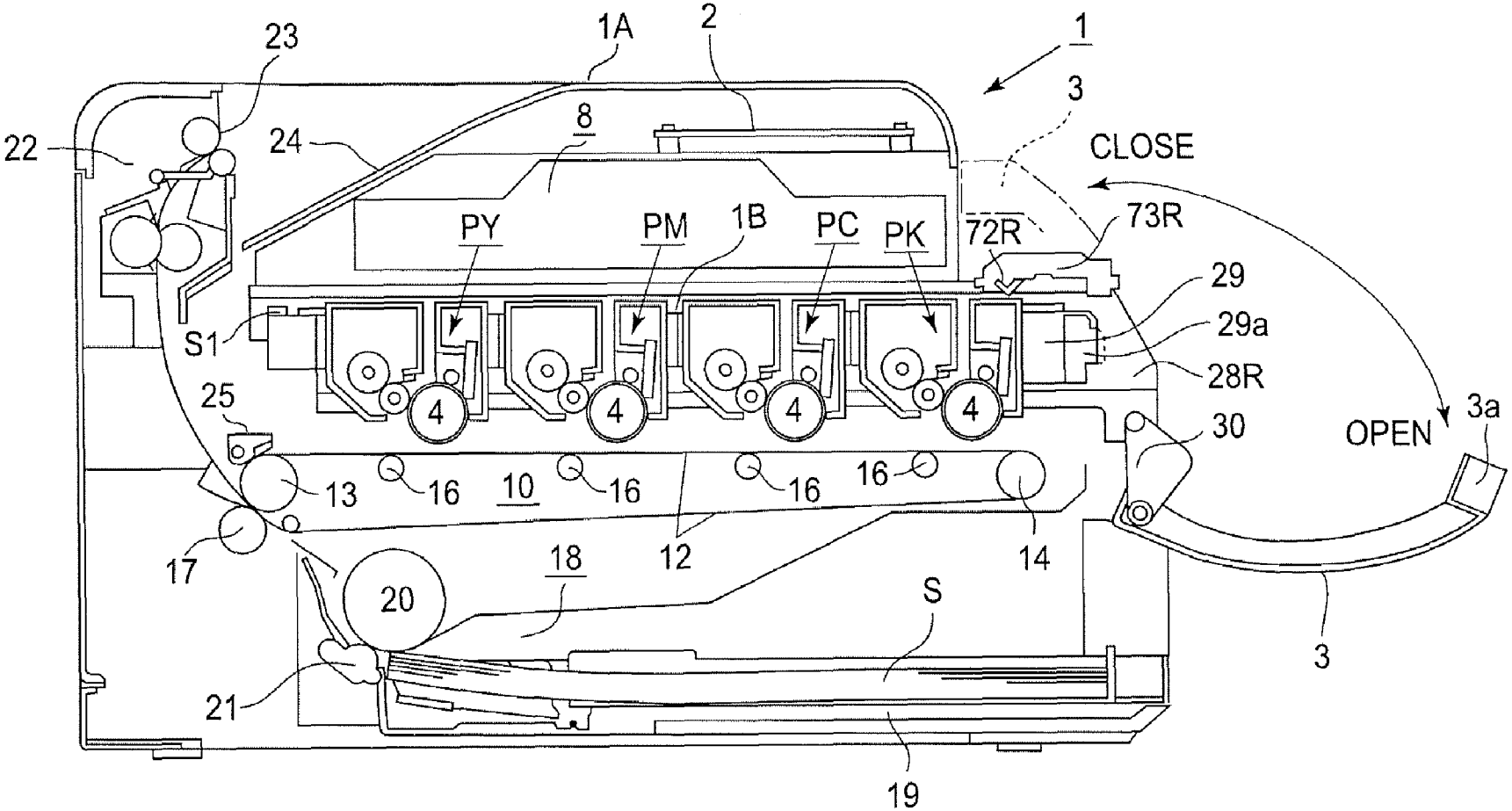
FIG. 5 is a vertical sectional view of the image forming apparatus in the preferred embodiment, the door of which is open, as seen from the left side of the apparatus main assembly.

In this embodiment, this door 3 is rotationally movable relative to the apparatus main assembly 1A about a shaft 27 (door hinge shaft) located at one of the horizontal edges of the door. That is, the door 3 is rotatable about the hinge shaft 27 so that it can be moved into the closed position, in which it remains shut against the apparatus main assembly 1A, covering the opening 26, as shown in FIGS. 1 and 2, and also, so that it can be rotated frontward about the hinge shaft 27 into the open position, as shown in FIGS. 4 and 5, widely exposing the opening 26. Designated by a reference character 3*a* is a handle, with which the door 3 is provided. Incidentally, the opening 26 is on the front side of the apparatus main assembly 1A.

The apparatus main assembly 1A is provided with a pair of tray supporting members 28L and 28R (tray moving means) (FIG. 4), which are attached one for one to the inward side of the left and right panels of the main frame of the apparatus main assembly 1A, opposing each other. The tray 29 is supported between the pair of holding members 28L and 28R, and by the pair of holding members 28L and 28R, being enabled to horizontally slide in the fore-and-after direction of the apparatus main assembly 1A. The cartridges PY, PM, PC, and PK are supported by the tray 29. Incidentally, the main frame constitutes the skeletal structure of the apparatus main assembly 1A. The tray 29 supports the cartridges so that they are horizontally juxtaposed in the fore-and-after direction.

The door 3 and the pair of holding members 28L and 28R are connected by a door linkage 30, so that as the door 3 is opened, the holding members 28L and 28R are moved both frontward and upward of the apparatus main assembly 1A by preset distances, by the movement of the door 3 transmitted to the holding members 28L and 28R through the door linkage 30, while being guided by a guiding member (unshown). As a result, the holding members 28L and 28R are pulled out of the apparatus main assembly 1A through the opening 26 so that the front end portion of each holding member 28 extends outward of the apparatus main assembly 1A by a preset distance, as shown in FIGS. 4 and 5.

As the holding members 28L and 28R are moved outward, the driving force output portions (which will be described later) of the apparatus main assembly are disengaged from the corresponding driving force input portions (which will be described later) of the cartridges PY, PM, PC, and PK, respectively (disengagement of driving force transmitting means). Further, the pressure applied to each cartridge by the pressure application mechanism to secure and correctly position the cartridge is removed from the cartridge (pressure removal). Further, the tray 29 is freed from its positional restriction. Further, the electrical contacts of each cartridge are disengaged from the power supply system of the apparatus main assembly, making it thereby impossible for electric power to be supplied to the cartridge from the power supplying system on the apparatus main assembly side (electrical disengagement). Moreover, the tray 29 which is holding the cartridges PY, PM, PC, and PK is moved upward with the holding members 28L and 28R, causing the cartridges to be lifted from the corresponding cartridge positioning portions of the apparatus main assembly 1A. As a result, the downwardly facing area of the peripheral surface of the drum 4 in each cartridge is separated from the surface of the belt 12 (FIG. 1-FIG. 5), making it possible for the tray 29 to be pulled out of the apparatus main assembly 1A.

Figure 6:
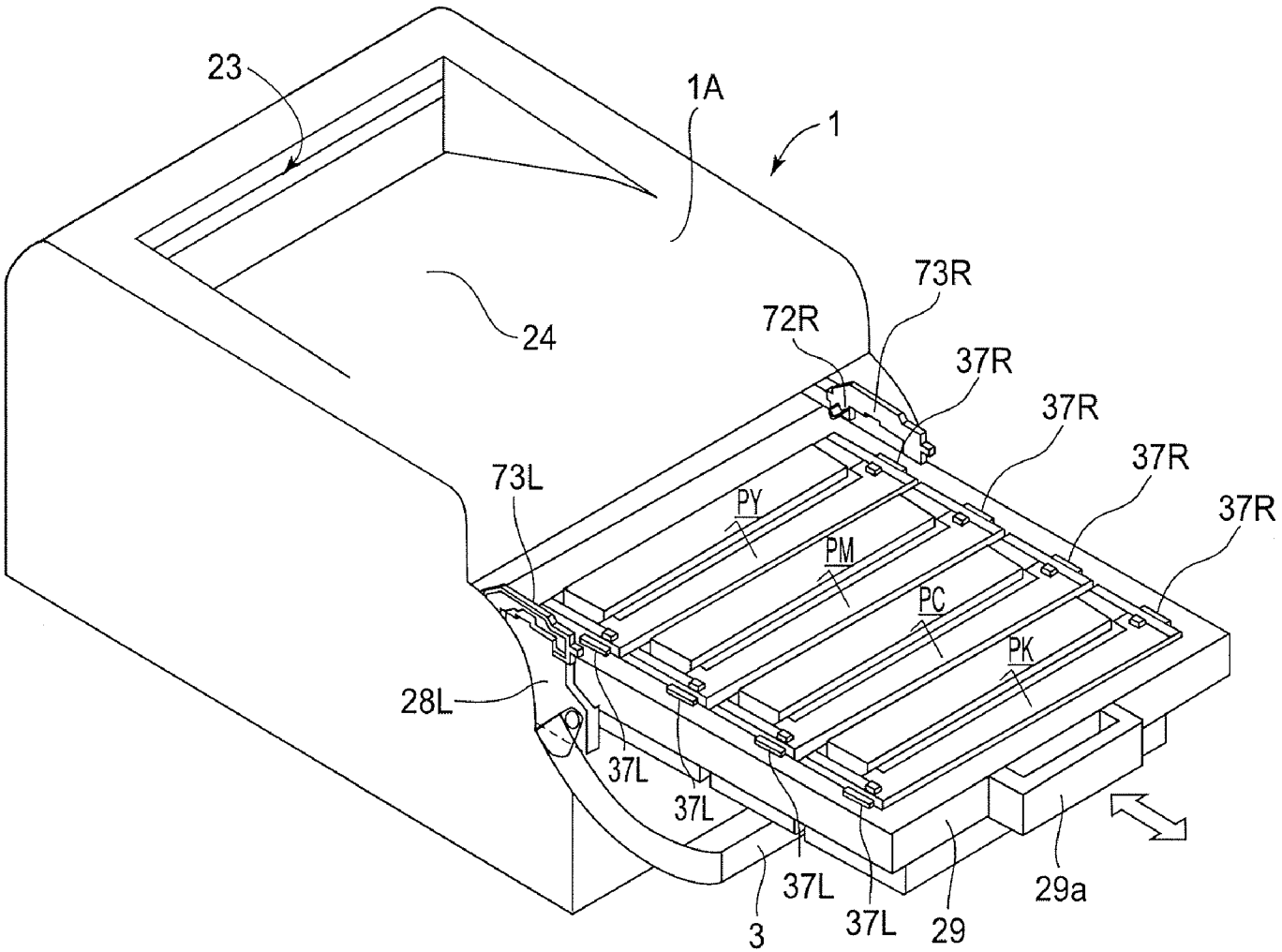
FIG. 6 is an external perspective view of the image forming apparatus in the preferred embodiment, the cartridge tray of which is in its most outward position.
Figure 7:
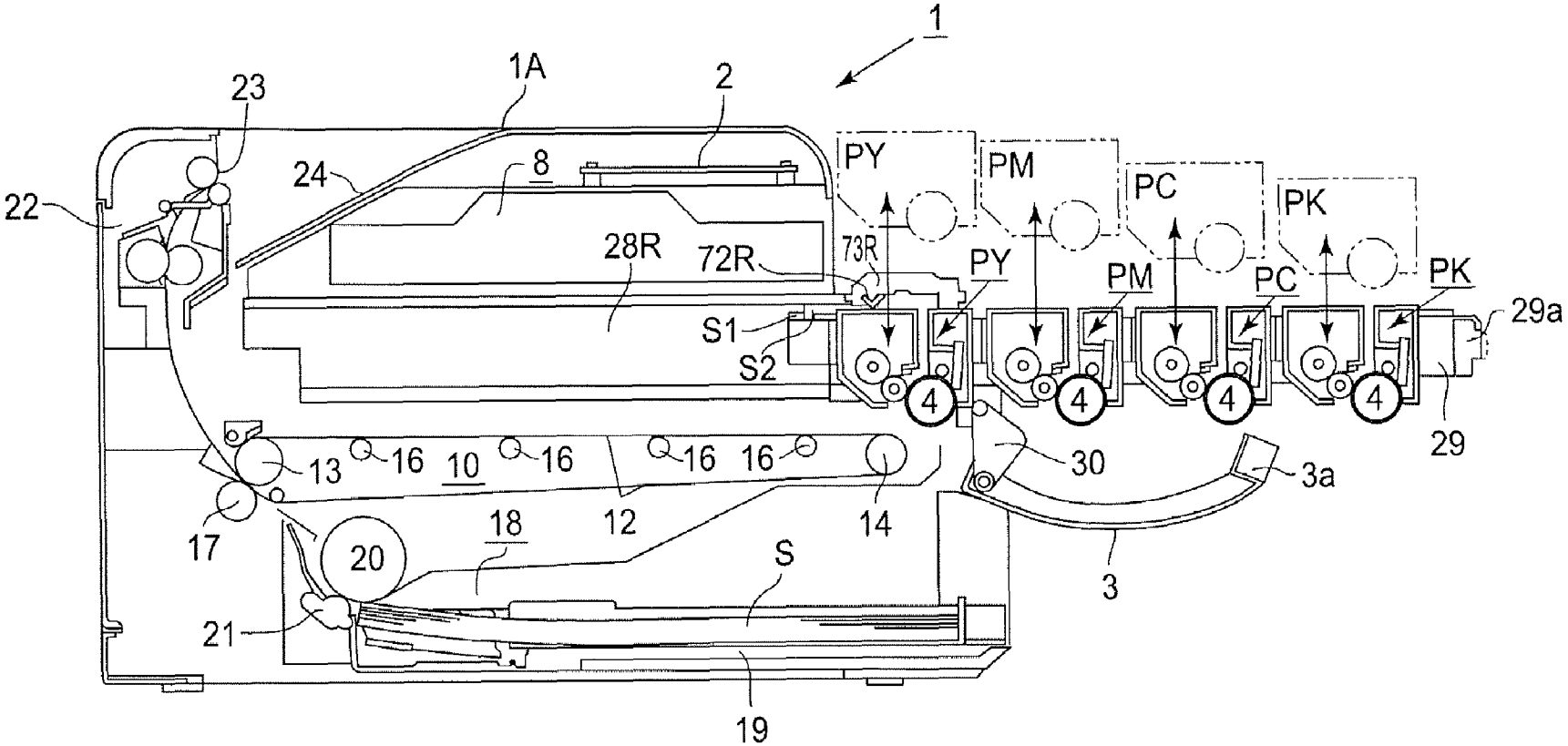
FIG. 7 is a vertical sectional view of the image forming apparatus in the preferred embodiment, the cartridge tray of which is in its most outward position, as seen from the left side of the apparatus.

At this point, the user is to grasp the handle 29*a* exposed through the opening 26, and pull the tray 29 in the horizontal and frontward direction to slide the tray 29 relative to the pair of holding members 28L and 28R so that the tray 29 comes out of the apparatus main assembly 1A through the opening 26, into its preset most outward position shown in FIGS. 6 and 7.

As the tray 29 is pulled out to the abovementioned preset position, the first-fourth cartridges PY, PM, PC, and PK held in the tray 29 are all moved out of the apparatus main assembly 1A through the opening 26, being exposed from the apparatus main assembly 1A; the top surface of each cartridge is exposed. The apparatus main assembly 1A is structured so that as the tray 29 is pulled out by a preset distance which is sufficient to expose all the cartridges, it is prevented by a pair of stoppers S1 and S2 from being pulled out further (FIG. 7), and also, so that once the tray 29 is pulled out to the preset most outward position, it is securely retained in this most outward position by the holding members 28L and 28R.

The tray 29 is structured to loosely hold each cartridge so that each cartridge can be moved out straight upward from the tray 29, and also, so that the replacement cartridge for each of the first to fourth cartridges can be mounted into the tray 29 from directly above. Thus, the user is to extract from the tray 29 the cartridge or cartridges, which are to be replaced, that is, the cartridge or cartridges, the life of which has expired, by simply lifting it, and then, fit a brand-new cartridge or cartridges, from directly above, into the vacated space or spaces, one for one, in the tray 29, as indicated by a double-dot chain line in FIG. 7.

After the user replaces the cartridge or cartridges in the tray 29 with a brand-new cartridge or cartridges, the user is to perform in reverse the above described sequence for placing a cartridge in the tray 29 or replacing the cartridge in the tray 29. That is, the user is to horizontally slide the tray 29, which is in the most outward position, relative to the holding members 28L and 28R, in the rearward direction of the apparatus main assembly 1A (direction indicated by arrow mark H in FIG. 17), so that the tray 29 is moved back into the apparatus main assembly 1A through the opening 26. The tray 29 is to be pushed back into the apparatus main assembly 1A to the point at which the stopper S1 prevents the tray 29 from being pushed further back into the apparatus main assembly 1A; in other words, the tray 29 is returned into the position shown in FIGS. 4 and 5.

Then, the user is to rotate the door 3 relative to the apparatus main assembly 1A to shut the door 3 against the apparatus main assembly 1A. As the door 3 is operated in the direction to be closed as described, the door linkage 30 is moved by the movement of the door 3, and the holding members 28L and 28R are pushed by the door linkage 30, in both the inward and downward direction of the apparatus main assembly 1A, while being guided by the guiding member (unshown). As the holding means 28L and 28R are moved, the movement of the holding means 28L and 28R causes the cartridge pressing mechanism to press each cartridge. As a result, each cartridge is pressed against the corresponding cartridge positioning portion of the apparatus main assembly 1A, being thereby correctly positioned relative to the apparatus main assembly 1A. Further, the driving force input portion of each of the cartridges PY, PM, PC, and PK is connected with the corresponding driving force output portion of the apparatus main assembly, and the input electric contacts of the cartridge are connected to the power supply system of the apparatus main assembly, enabling the cartridges to be supplied with the power from the apparatus main assembly 1A. Further, the tray 29 is securely and correctly positioned relative to the apparatus main assembly 1A, and the downwardly facing area of the peripheral surface of the drum 4 in each cartridge is placed in contact with the surface of the belt 12. That is, the state of the image forming apparatus, shown in FIGS. 1 and 2, in which each of the cartridges PY, PM, PC, and PK is in its preset image formation position in the apparatus main assembly 1A, is restored; each cartridge is placed in the cartridge chamber 1B. In other words, the image forming apparatus 1 is readied for an image forming operation.

As described above, the tray 29 is movable in a straight line in the direction perpendicular to the lengthwise direction (which is parallel to the axis) of the drum 4 of each cartridge, while holding multiple cartridges so that they are horizontally arranged in the fore-and-after direction, with their lengthwise direction being parallel to the side-to-side direction of the apparatus main assembly 1A. The tray 29 can be moved into or out of the apparatus main assembly 1A; the tray 29 is enabled to take the most outward position, relative to the apparatus main assembly 1A, in which it allows the cartridges to be mounted into, or dismounted from, the tray 29, a transitional position from which the tray 29 is moved into the apparatus main assembly in the slantingly downward direction, and a latent image formation position in which it allows an electrostatic latent image to be formed on the drum 4 of each cartridge. Incidentally, the tray 29 is a movable member.

In this embodiment, the tray 29 holds the cartridges PK, PC, PM, and PY, in which the developers of K, C, M, and Y colors, respectively, are stored. The order in which the cartridges PK, PC, PM, and PY are arranged in the tray 29 is the same as they are listed above. Namely, in terms of the upstream to downstream direction, that is, the direction in which the tray 29 is moved inward of the apparatus main assembly 1A from outward of the apparatus main assembly 1A, the cartridges PY, PM, PC, and PK are arranged in the listed order. In other words, in this embodiment, the cartridges are arranged according to the amount of developer consumption, so that the cartridge highest in developer consumption, that is, the cartridge highest in replacement frequency, is placed closest to the side from which the user operates the image forming apparatus. Therefore, the distance by which the tray 29 must be pulled out of the apparatus main assembly to expose the cartridge PK is very small; if the cartridge to be replaced is the cartridge PK, it is unnecessary to pull out the tray 29 to the point at which the pair of stoppers S1 and S2 prevents the tray 29 from being further pulled out. Thus, the image forming apparatus 1 in this embodiment is superior to an image forming apparatus in accordance with the prior art, in terms of the efficiency with which the cartridge PK can be replaced. Incidentally, the stopper S1 is a part of the tray 29, whereas the stopper S2 is a part of the apparatus main assembly 1A. When the tray 29 is pulled out of the apparatus main assembly 1A, the stopper S1 comes into contact with the stopper S2, preventing the tray 29 from being pulled out further, as shown in FIG. 7. When pushing the tray 29 back into the apparatus main assembly 1A, the stopper S1 comes into contact with the stationary counterpart (unshown) of the apparatus main assembly 1A, preventing the tray 29 from being pushed further into the apparatus main assembly 1A.

Before the left and right holding members 28L and 28R allow the tray 29 to be moved into the abovementioned most outward position, in which the tray 29 allows the cartridges to be mounted or dismounted, they move the tray 29 upward from the abovementioned latent image formation position (they move tray 29 downward from transitional position as door 3 is closed). In other words, the holding members 28L and 28R are members for supporting the tray 29, and are enabled to take the first position, in which they allow the tray 29 to be moved between the abovementioned most outward position and transitional position, and the second position, in which they retain the tray 29 in the abovementioned latent image formation position. As the door 3 is closed, the holding members 28L and 28R are moved from the first position to the second position by the movement of the door 3. Further, as the door 3 is opened, the holding members 28L and 28R are moved from the second position to the first position by the movement of the door 3. The holding members 28L and 28R constitute the moving means.

<Cartridge>

The first to fourth cartridges PY, PM, PC, and PK in this embodiment are the same in structure. Next, referring to FIGS. 8-14, the cartridge structure in this embodiment will be described.

Figure 8:
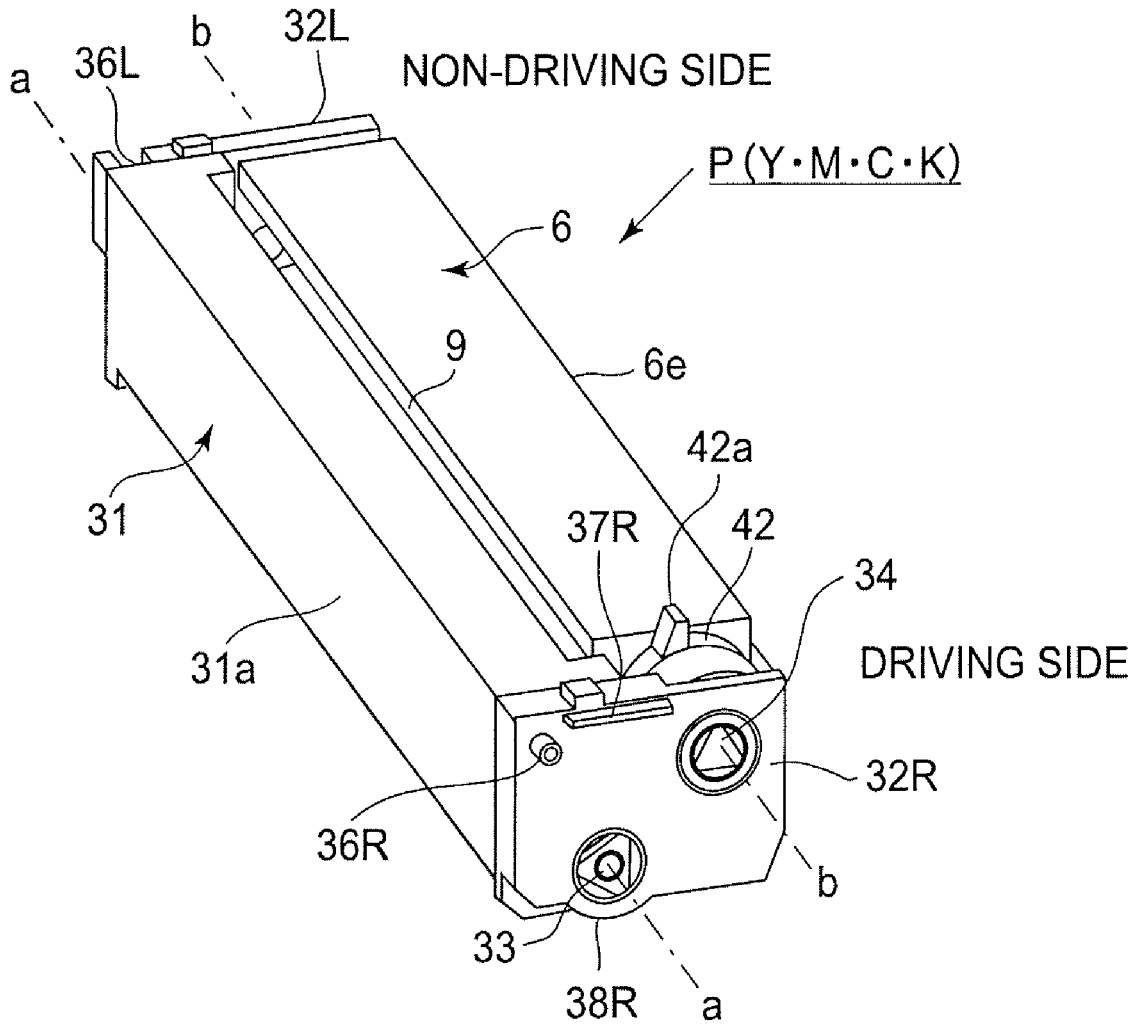
FIG. 8 is an external perspective view of the cartridge, as seen from the side from which the cartridge is driven.
Figure 9:
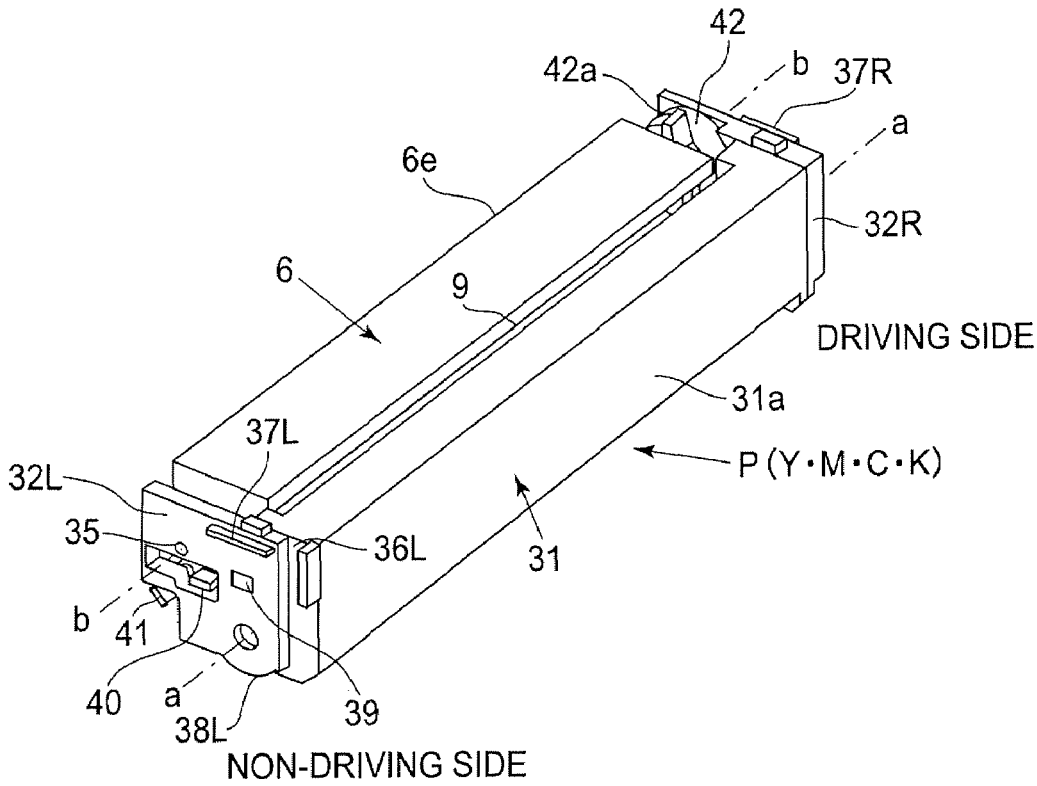
FIG. 9 is an external perspective view of the cartridge, as seen from the side from which the cartridge is not driven.
Figure 10:
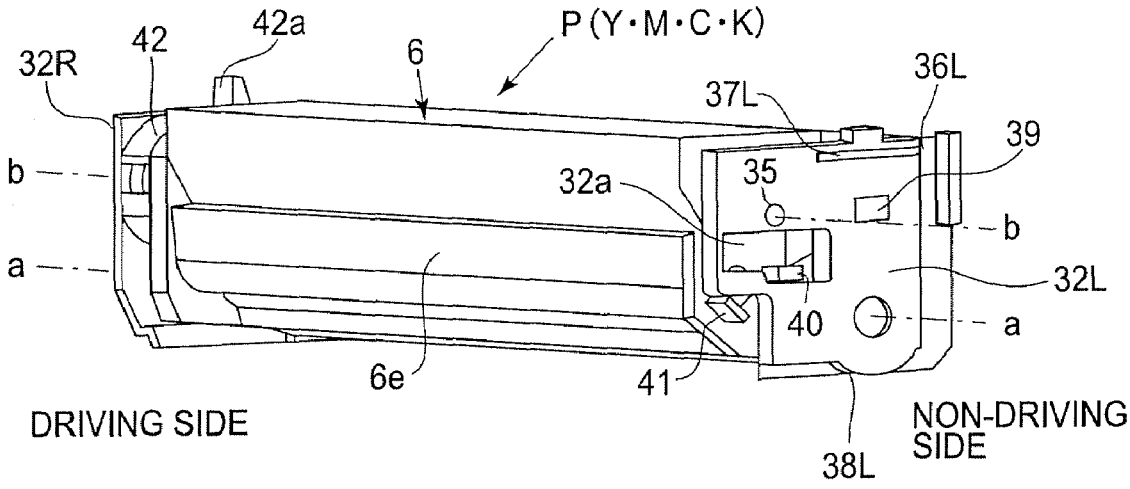
FIG. 10 is an external perspective view of the cartridge, as seen from the angle different from the angle from which the cartridge is seen in FIG. 9.
Figure 11:
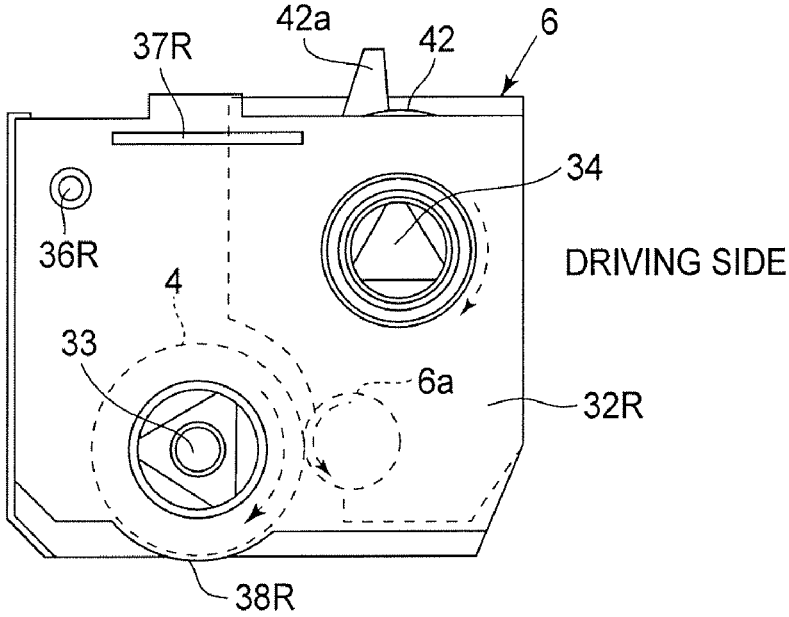
FIG. 11 is a plan view of the lengthwise end of the cartridge, from which the cartridge is driven.
Figure 12:
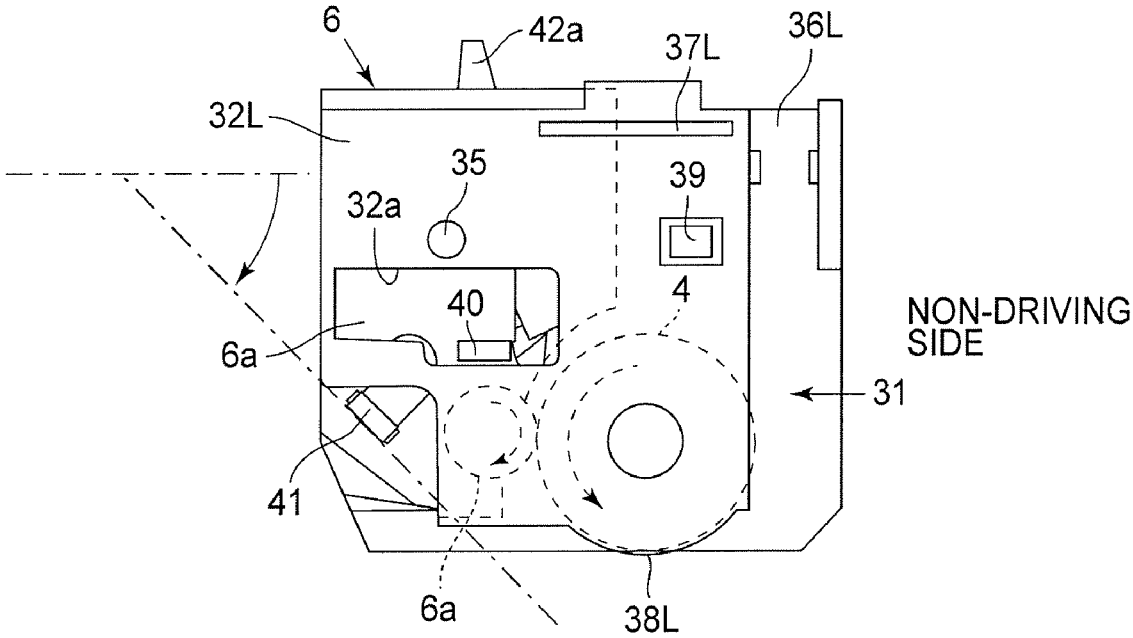
FIG. 12 is a plan view of the lengthwise end of the cartridge, from which the cartridge is not driven.
Figure 13:
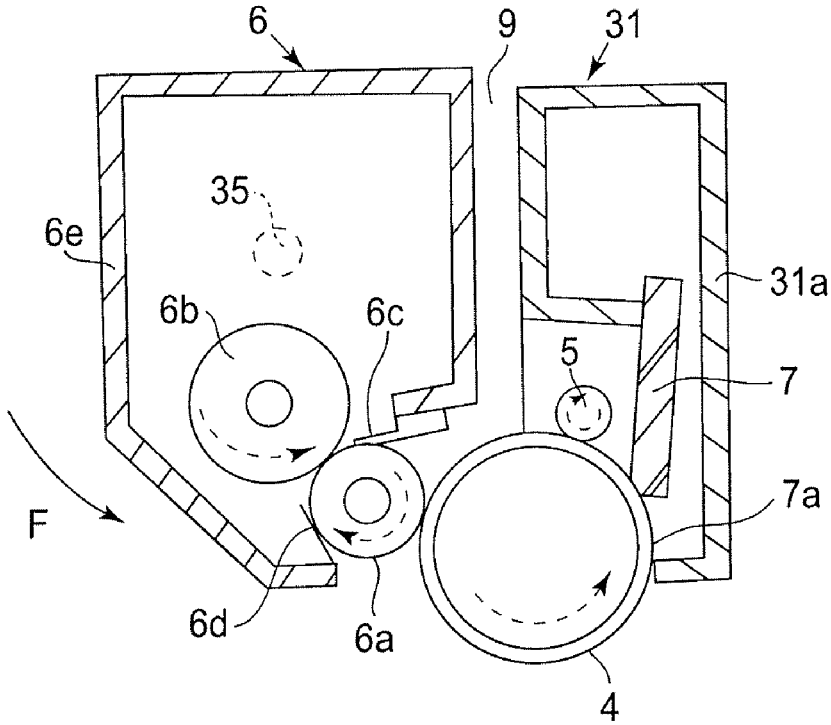
FIG. 13 is a cross-sectional view of the cartridge, (in which drum is in contact with development roller).
Figure 14:
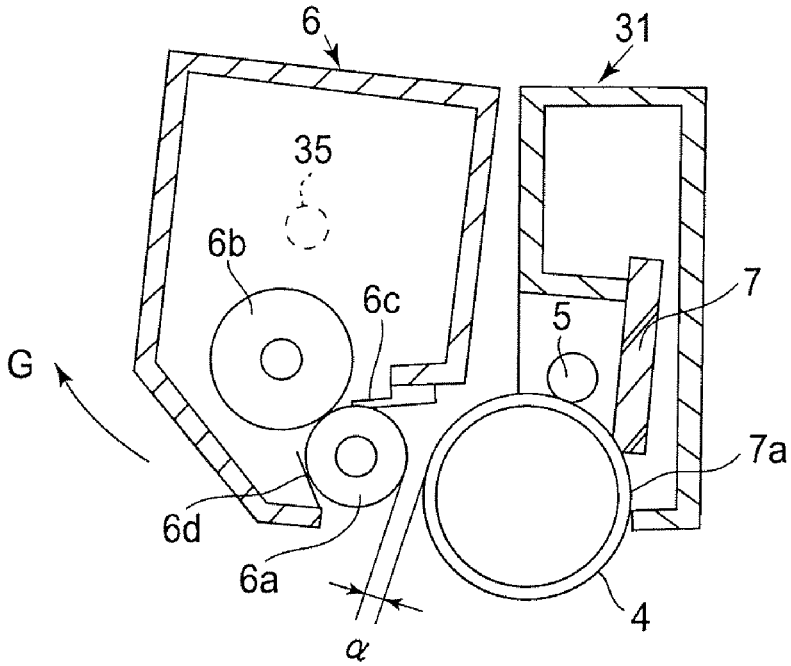
FIG. 14 is a cross-sectional view of the cartridge, (in which drum is not in contact with development roller).

FIG. 8 is a perspective view of the cartridge, as seen from the aforementioned driven side, and FIG. 9 is a perspective view of the cartridge, as seen from the aforementioned non-driven side. FIG. 10 is also a perspective view of the cartridge, as seen from the non-driven side, as is FIG. 9, but is different in the viewing angle. FIG. 11 is a plan view of the driven side (right-hand) end surface of the cartridge, and FIG. 12 is a plan view of the non-driven side (left-hand) end surface of the cartridge. FIG. 13 is a cross-sectional view of the cartridge in which the development roller 6*a* is in contact with the drum 4, and FIG. 14 is a cross-sectional view of the cartridge in which the development roller 6*a* is not in contact with the drum 4.

The leftward or rightward direction of each cartridge is the direction parallel to the axis a-a of the drum 4. The cartridge is an assembly, the lengthwise direction of which is the same as its leftward or rightward direction. The cartridge has a drum unit 31 (first unit), a development unit 6 (second unit), left panel 32L, and right panel 32R.

The drum unit 31 has a cleaning means container 31*a* (cleaning means housing), in which the drum 4, the charge roller 5, the cleaning blade 7, and a developer leakage prevention sheet 7*a* are disposed (FIG. 13). The drum 4 is rotatably held by, and between, the left and right panels of the container 31*a*, with bearings placed between the drum 4 and the panels. The charge roller 5 is placed in contact with the drum 4, and is rotatably attached to, and between, the left and right panels, with bearings placed between the charge roller 5 and the left and right panels. The blade 7 is formed of elastic rubber. The blade 7 is fixed to the container 31*a* by its base portion, in contact with the drum 4, being tilted so that, in terms of the rotational direction of the drum 4, the base portion of the blade 7 is on the downstream side of the cleaning edge portion of the blade 7. The blade 7 plays the role of removing the developer remaining on the drum 4. The developer removed from the peripheral surface of the drum 4 is stored in the container 31*a*. The sheet 7*a* is located below the blade 7, and is placed in contact with the drum 4, being tilted so that, in terms of the rotational direction of the drum 4, the edge portion of the sheet 7*a*, which is in contact with the drum 4, is on the downstream side of the edge portion of the sheet 7*a*, by which the sheet 7*a* is attached to the container 31*a*. The sheet 7*a* prevents the developer from leaking from the container 31*a* through the gap between the container 31*a* and drum 4.

The development unit 6 is provided with a developing means container 6*e* (developing means housing). It also has a development roller 6*a*, a developer supply roller 6*b* (developer coating roller), a developer regulating member 6*c*, and a developer leak prevention sheet 6*d*, which are disposed in the container 6*e*. The developer is stored in the container 6*e*. The development roller 6*a* is a roller formed of elastic rubber. It is located between the left and right panels of the container 6*e*, and is rotatably supported by the left and right panels, with bearings placed between the development roller 6*a* and left and right panels. The developer supply roller 6*b* is a roller for supplying (coating) the development roller 6*a* with developer. It is disposed, in contact with the development roller 6*a*, between the left and right panels of the container 6*e*, and is rotatably supported by the left and right panels, with bearings placed between the development supply roller 6*b*, and left and right panels. The developer regulating member 6*c* is a piece of thin elastic plate, and is fixed to the container 6*e* by one of its edge portions. It is placed in contact with the development roller 6*a*. It is on the downstream side of the developer supply roller 6*b*, in terms of the rotational direction of the development roller 6*a*, and is tilted so that the contact area between the regulating member 6*c* and development roller 6*a* is on the upstream side of its portion by which it is fixed to the container 6*e*. The regulating member 6*c* regulates in thickness the body of developer coated on the development roller 6*a* by the supply roller 6*b*; it forms a developer layer with a preset thickness, on the development roller 6*a*. The sheet 6*d* is placed in contact with the development roller 6*a*. It is tilted so that, in terms of the rotational direction of the development roller 6*a*, the contact area between the sheet 6*d* and development roller 6*a* is on the downstream side of its portion by which it is anchored to the container 6*e*. The sheet 6*d* prevents the developer from leaking from the container 6*e* through the gap between the development roller 6*a* and container 6*e*.

The left panel 32L is solidly attached to the outward surface of the left end wall of the container 31*a*, with a part of the left panel 32L extending rearward from the container 31*a*. The right panel 32R is solidly attached to the outward surface of the right end wall of the container 31*a*, with a part of the right panel 32R extending rearward from the container 31*a*. The development unit 6 is positioned between the abovementioned rearwardly extending portions of the left and right panels 32L and 32R, respectively, and is supported so that it is enabled to rotate, in the oscillatory fashion, about an axis b-b, which is parallel to the axis a-a of the drum. That is, the development unit 6 is joined with the drum unit 31 so that the two units are allowed to rotationally move relative to each other. The cartridge is structured so that the rotational axis b-b of the development unit 6 coincides with the axis of the development roller driving coupling (second driving force input portion, that is, developer roller driving force receiving portion, which will be described later in detail), which is on the right panel 32R side, and also, so that the rotational axis b-b of the development unit 6 coincides with the axis of the development roller supporting shaft 35, which is on the left panel 32L side, that is, the non-driven side. The cartridge is structured so that, in terms of the coordinates on a plane perpendicular to the lengthwise direction of the cartridge, the cross-sectional center of the supporting shaft 35 practically coincides with the axis of the coupling 34. That is, the axis of the coupling 34 practically coincides with the axis of the supporting shaft 35.

Each cartridge is provided with the drum driving coupling 33 (first driving force input portion, that is, drum driving force receiving portion), the development roller driving coupling 34, and a cartridge rotation preventing portion 36R (protrusion: first rotation controlling portion or first portion-to-be-regulated), which are located at one of the lengthwise ends of the cartridge, that is, the lengthwise end on the driven side. Each cartridge is also provided with a rib 37R (first rib or first portion=to-be-supported) by which the cartridge is supported by the cartridge chamber 1B, on the driven side, and a cartridge positioning portion 38R (first cartridge positioning portion of cartridge or first portion-to-be-positioned, which is on driven side). The axis of the drum driving coupling 33 coincides with that of the drum.

The lengthwise end wall of the cartridge, on the non-driven side, is provided with a cartridge rotation preventing portion 36L (channel: second rotation controlling portion or second portion-to-be-regulated) and a rib 37L (second portion or second portion-to-be-supported by which cartridge is supported by cartridge tray), and a cartridge positioning portion 38L (second cartridge positioning portion of cartridge or second portion-to-be-positioned).

As the cartridge is moved into its preset image forming position in the apparatus main assembly 1A (cartridge chamber 1B), the couplings 33 and 34 are engaged with the first and second driving force output portions (unshown) of the apparatus main assembly side, respectively; when the cartridge is in its preset image formation position, the coupling 33 and 34 are in engagement with the first and second driving force output portions. As driving force is transmitted from the first driving force output portion to the coupling 33, the drum 4 is rotationally driven by the transmitted driving force in the counterclockwise direction (FIG. 13) at a preset peripheral velocity. The charge roller 5 is rotated by the rotation of the drum 4. As the driving force is transmitted from the second driving force output portion to the coupling 34, the transmitted driving force is transmitted to the development roller 6*a* and developer supply roller 6*b* (developer coating roller) through a driving force transmission gear train (unshown), causing each of the development roller 6*a* and developer supply roller 6*b* to rotate in the clockwise direction (FIG. 13) at a preset peripheral velocity. The developer in the container 6*e* is supplied to (coated on) the rotating development roller 6*a* by the rotating supply roller 6*b*. The body of developer coated on the development roller 6*a* is regulated in thickness by the developer regulating member 6*c*, forming a developer layer with a preset thickness, on the development roller 6*a*. Then, the developer on the development roller 6*a* is conveyed by the rotation of the development roller 6*a* to a development area, that is, the contact area between the development roller 6*a* and drum 4, in which the developer is used for developing the electrostatic latent image on the drum 4. The developer remaining on the peripheral surface of the development roller 6*a* after the development of the electrostatic latent image is returned by the rotation of the development roller 6*a* to the container 6*e*, in which the developer is removed by the supply roller 6*b* from the peripheral surface of the development roller 6*a* at the same time as the peripheral surface of the development roller 6*a* is coated with a fresh supply of developer, that is, the developer in the container 6*e*, by the supply roller 6*b*.

As each cartridge is inserted into the tray 29, the cartridge rotation preventing portions 36R and 36L of the cartridge, which are on the driven and non-driven sides, respectively, engage with the cartridge rotation preventing portions (29*h* and 29*i*) of the tray 29, respectively, as will be described later in detail. The cartridge rotation preventing portions 36R and 36L prevent the cartridge from rotating when the cartridge is correctly positioned relative to the apparatus main assembly 1A. That is, they prevent the cartridge from rotating when the cartridge receives the rotational driving force from the apparatus main assembly 1A. Incidentally, after the cartridge is dropped into the tray 29, that is, immediately after the cartridge is placed in the tray 29, each of the cartridge rotation preventing portion 36R and 36L may be, or may not be, in contact with the inward surface of the corresponding cartridge rotation preventing portion (29*h* or 29*i*) of the main assembly side. However, as the cartridge receives the rotational driving force from the apparatus main assembly 1A, they come into contact with the inward surfaces of the cartridge rotation preventing portions (29*h* and 29*i*), respectively, preventing thereby the cartridge from rotating.

The ribs 37R and 37L, by which the cartridge is supported on the driven and non-driven sides, respectively, protrude outward from the top edge portions of the right and left end panels 32R and 32L, respectively, in the direction parallel to the lengthwise direction of the cartridge. The ribs 37R and 37L extend in the width direction of the cartridge; they are in the form of a long and narrow rectangular parallelepiped. As the cartridge is inserted into the tray 29, the ribs 37R and 37L rest on the areas 29*m* and 29*n* of the top surface 29x (FIG. 15) of the tray 29, preventing thereby cartridge from falling through the tray 29.

Designated by reference characters 72R and 72L are right and left cartridge pressing members, respectively. The cartridge pressing members 72R and 72L are members which move an upwardly deviant cartridge (cartridges) in the tray 29 into its correct position in the tray 29, when the tray 29 is pushed into the apparatus main assembly 1A. That is, the right pressing member 72R presses on the right rib 37R of the cartridge to press the rib 37R upon the top surface 29*x* of the tray 29, and the left pressing member 72L presses on the left rib 37L of the cartridge to press the rib 37L on the top surface 29*x* of the tray 29. Designated by reference characters 73R and 73L are right and left plates for supporting the right and left pressing members 72R and 72L, respectively. That is, the supporting plate 73R is the member to which the pressing member 72R is attached. It is attached to the holding member 28R. The supporting plate 73L is the member to which the pressing member 72L is attached. It is attached to the holding member 28L (FIGS. 3 and 4).

The first rib 38R, as one the cartridge positioning members of the cartridge, which is on the driven side, is an arcuate downward protrusion. It protrudes from the bottom edge of the right panel 32R, and the center of its arcuate portion coincides with the axis of the drum 4. The second rib 38L, as the other cartridge positioning members of the cartridge, which is on the non-driven side, is also an arcuate downward protrusion. It protrudes from the bottom edge of the right panel 32L, and the center of its arcuate portion also coincides with the axis of the drum 4. As the tray 29 is pushed into the apparatus main assembly 1A while holding a cartridge, the cartridge positioning (supporting) portions 38R and 38L engage with the cartridge positioning portions (unshown), one for one, with which the apparatus main assembly 1A is provided, correctly positioning the cartridge relative to the cartridge chamber 1B. Then, while the cartridge is in the correct position in the cartridge chamber 1B of the apparatus main assembly 1A, they remain engaged with the cartridge positioning portions of the apparatus main assembly 1A, keeping thereby the cartridge correctly positioned relative to the cartridge chamber 1B. More specifically, the positioning portions 38R and 38L of the cartridge are correctly positioned relative to the cartridge positioning portions (unshown) of the apparatus main assembly while the tray 29 (movable member) is lowered toward the transfer belt 12.

The left panel 32L is provided with a first input electrical contact 39, which is on the outward surface of the left panel 32L. The container 6*e* is provided with a second input electrical contact 40 and a third electrical contact 41, which are on the outward surface of the lengthwise end wall of the container 6*e*, on the non-driven side. The second input electrical contact 40 is exposed outward through a window 32*a*, with which the left panel 32L is provided. The third input electrical contact 41 is slanted downward relative to the horizontal plane, as shown in FIG. 12.

The first input electrical contact 39 is the electrical contact through which charge bias is applied to the charge roller 5 (charge roller bias application electrical contact). This electrical contact 39 is placed, and kept, in contact with one of the lengthwise end surfaces of the shaft of the charge roller 5, by its elastic extension. Thus, it maintains electrical contact between the charge roller 5 and the power supply on the apparatus main assembly side while sliding on the abovementioned end surface of the charge roller shaft.

The second input electrical contact 40 is the electrical contact through which development bias is applied to the development roller 6*a* (developer bias application electrical contact). This electrical contact 40 is placed, and kept, in contact with one of the lengthwise end surfaces of the shaft of the development roller 6*a*, by its elastic extension. Thus, it maintains electrical contact between the development roller 6*a* and the power supply on the apparatus main assembly side while sliding on the abovementioned end surface of the development roller shaft.

The third input electrical contact 41 is the electrical contact through which bias is applied to the developer supply (coating) roller 6*b* (developer supplying (coating) roller bias application electrical contact). This electrical contact 41 is placed, and kept, in contact with one of the lengthwise end surfaces of the shaft of the developer supplying roller 6*b*, by its elastic extension. Thus, it maintains electrical contact between the developer supplying roller 6*b* and the power supply on the apparatus main assembly side while sliding on the abovementioned end surface of the developer supplying roller shaft.

The development unit 6 is kept pressed by pressure application springs (unshown) in the direction, indicated by an arrow mark F (FIG. 13), to rotate about the axis a-a so that the development roller 6*a* is placed, and kept, in contact with the drum 4. The cartridge is provided with a pressure removal cam 42, which is rotatable to rotate the development unit 6, against the abovementioned pressure application springs, about the axis a-a, in the direction, indicated by an arrow mark G (FIG. 14), to cause the development roller 6*a* to separate from the drum 4. The pressure removal cam 42 can be kept in the position in which it keeps the development roller 6*a* separated from the drum 4. It can be selectively rotated by its knob 42*a* in the direction to allow the pressure application springs to keep the development roller 6*a* in contact with the drum 4, or in the direction to keep the development roller 6*a* separated from the drum 4 by removing the pressure from the pressure application springs. While the cartridge is distributed or kept stored, the cam 42 is kept in the pressure removal position into which the cam 42 is rotatable, to keep the development roller 6*a* separated from the drum 4 by a distance $\alpha$ (FIG. 14), in order to prevent the development roller 6*a* from sustaining permanent deformation or the like. Thus, before the cartridge is used for image formation for the first time, or after it has been stored, the cam 42 is to be rotated in the direction to allow the pressure application springs to apply pressure to the development unit 6, in order to place the development roller 6*a* in contact with the drum 4 (FIG. 13), so that the cartridge is readied for image formation. As the cam 42 is rotated into the position (FIG. 13) in which it allows the pressure application springs to apply pressure to the development unit 6, a gap is created between the drum unit 31 and development unit 6. This gap serves as the exposure window 9.

<Cartridge Tray>

Figure 15:
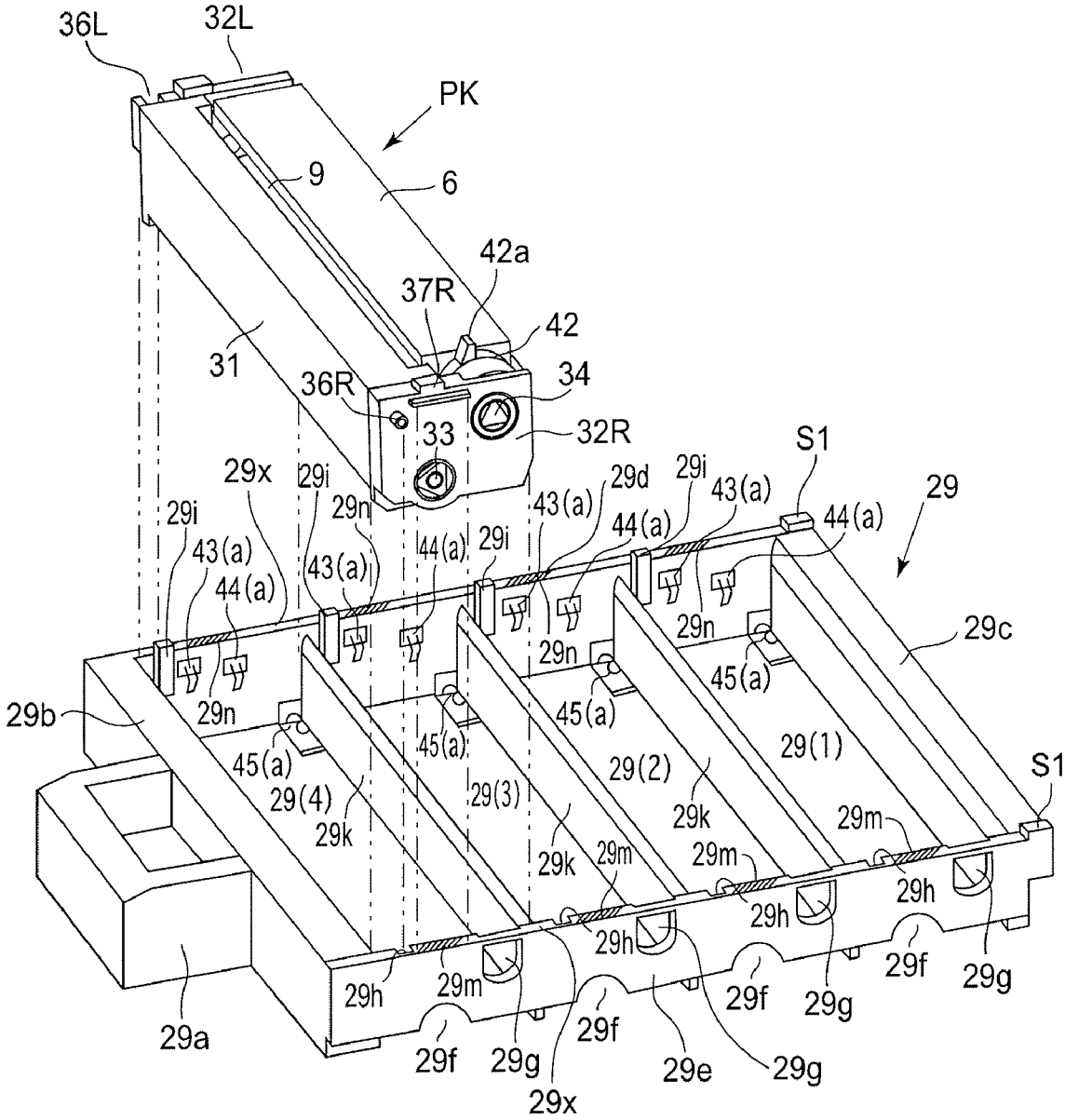
FIG. 15 is an external perspective view of the cartridge tray, as seen from the side from which the cartridge is driven.
Figure 16:
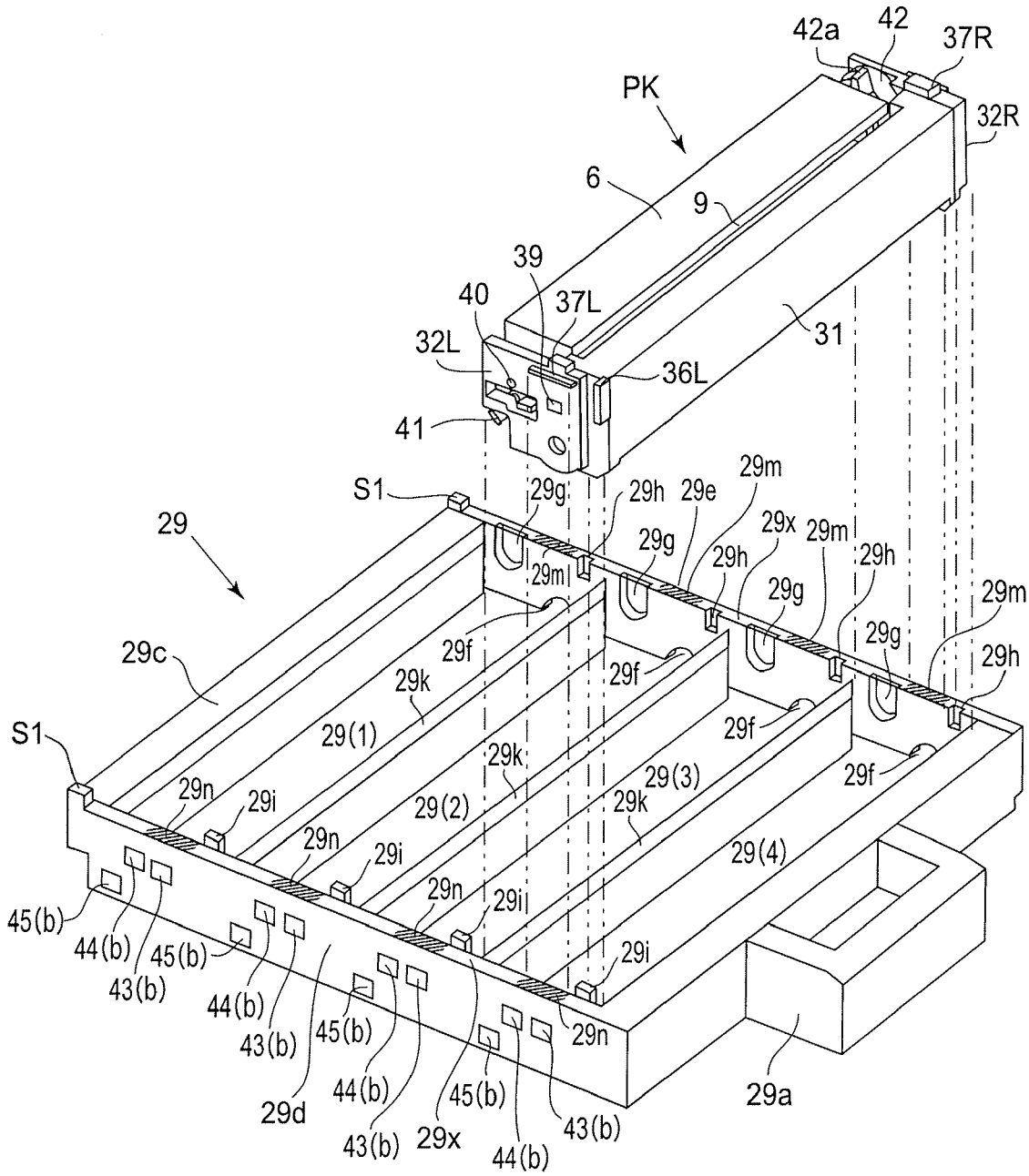
FIG. 16 is an external perspective view of the cartridge tray, as seen from the side from which the cartridge is not driven.

Next, referring to FIGS. 15 and 16, the tray 29 will be described. The tray 29 has a rectangular main frame, which is made up of four sections 29*b*, 29*c*, 29*d*, and 29*e*, which are joined at their lengthwise ends. The space within the rectangular main frame is partitioned into four rectangular sub-spaces of roughly the same size by three partition plates 29*k*. The four sub-spaces are arranged in the fore-and-after direction, and their long edges are parallel to the side-to-side direction of the apparatus main assembly 1A. Hereafter, these four sub-spaces will be referred to as first-fourth cartridge compartments 29(1)-29(4), listing from the rear section 29*c* side toward the front section 29*b*. These cartridge compartments 29(1)-29(4) of the tray 29 are the compartments into which the first to fourth cartridges PY, PM, PC, and PK are inserted to be held therein one for one (cartridge compartment; cartridge slot). The tray 29 loosely holds the cartridges PY, PM, PC, and PK, in its four cartridge compartments 29(*a*)-29(4), the long edges of which are parallel to the side-to-side direction of the apparatus main assembly 1A. That is, as described above, the ribs 37R and 37L of each cartridge rest on the top surface (top surface of tray 29) of the frame portion of the corresponding cartridge compartment, preventing the cartridge from falling through the tray 29.

The lengthwise end wall of each of the cartridge compartments 29(1)-29(4), which corresponds to the right section 29*e* (driven side) of the main frame of the tray 29, is provided with holes 29*f* and 29*g*, through which the first and second driving force output portions on the apparatus main assembly side move into, or out of, the cartridge compartment (tray 29). It is also provided with a recess 29*h* into which the cartridge rotation preventing portion 36R on the driven side fits. The lengthwise end wall of each cartridge compartment, which corresponds to the left section 29*d* (non-driven side) of the main frame of the tray 29, is provided with a rib 29*i*, which fits into the cartridge rotation preventing portion 36L on the non-driven side. It is also provided with the first to third intermediary electrical contacts 43-45, which will become connected to the first to third input electrical contacts 39-41 of the cartridge, as the cartridge is moved into the preset image forming position in the apparatus main assembly 1A.

Each of the intermediary electrical contacts 43-45 has an inward portion (a), which is exposed on the inward side of the corresponding cartridge compartment of the tray 29, and an outward portion (b), which is exposed on the outward side of the corresponding cartridge compartment of the tray 29. The inward portion (a) and outward portion (b) are electrically connected to each other. When the cartridge is in its proper position in the tray 29, the inward portions (a) of the intermediary electrical contacts 43-45 are electrically in contact with the first to third input electrical contacts 39-41 of the cartridge, respectively. Further, when the cartridge is in the proper position in the cartridge chamber 1B in the apparatus main assembly 1A, the outward portions (b) of the intermediary electrical contacts 43-45 are electrically in contact with the output electrical contacts of the apparatus main assembly 1A (main assembly electrical contacts (unshown)), one for one.

As for the method for inserting the cartridges PY, PM, PC, and PK into the cartridge compartments 29(1)-29(4), respectively, the cartridges may be released into the cartridge compartments from above. As the cartridges are released, the cartridge rotation preventing portions 36R and 36L of each cartridge, which are on the driven and non-driven side, engage with the recess 29*h* and rib 29*i* of the tray 29, respectively. That is, the cartridge rotation preventing portion 36R fits into the recess 29*h*, and the cartridge rotation preventing portion 36L fits around the rib 29*i* (FIG. 15). As each cartridge falls further into the corresponding cartridge compartment of the tray 29, the bottom surface of the rib 37R is caught by the top surface of the left section 29*e* of the tray frame, and the bottom surface of the rib 37L is caught by the top surface of the section 29*d* of the tray frame (FIG. 15). As a result, the cartridge rests on the tray 29; the cartridge is supported by the tray 29. That is, at this point, the tray 29 is supporting the cartridge so that the cartridge can be removed from the tray 29 by simply lifting the cartridge straight upward; the cartridge is supported by the tray 29 by being simply lowered into the tray 29 from straight above. Further, as the cartridge is lowed into the tray 29, the first to third input electrical contacts 39-41 of the cartridge come into contact, and remain in contact, with the inward portions (a) of the intermediary electrical contacts 43-45 of the tray 29, respectively, establishing thereby electrical connection between the cartridge and tray 29. As the tray 29 is moved into the apparatus main assembly 1A, the movement of the tray 29 moves each cartridge into the preset latent image forming position of the cartridge, in the apparatus main assembly 1A, and the outward portions (b) of the intermediary electrical contacts 43-45 of the tray 29 come into contact with the output electrical contacts of the apparatus main assembly 1A, establishing electrical connection between the tray 29 and apparatus main assembly 1A. As a result, the first to third input electrical contacts 39-41 of the cartridge become electrically connected to the power supply system of the apparatus main assembly 1A through the intermediary electrical contacts 43-45 of the tray 29. The intermediary electrical contacts 43-45 supply the cartridge with the biases which they receive from the output electrical contacts of the apparatus main assembly 1A.

<Relationship Between Intermediary Electrical Contacts and Cartridge>

Next, referring to FIGS. 15, 16, and 17, the relationship between the intermediary electrical contacts 43-45 with which the tray 29 is provided, and each cartridge, will be described.

In this embodiment, the first to third intermediary electrical contacts 43-45 of each of the first to fourth cartridge compartments 29(1)-29(4) of the tray 29 are located at the lengthwise end of the cartridge compartment, on the non-driven side. The inward portions (a) of the first and second intermediary electrical contacts 43 and 44 are on the inward surface of the left portion 29*d* of the tray frame, and the inward portion (a) of the third intermediary electrical contact 45 is at the bottom of the cartridge compartment (29(1)-29(4)), and is at the most downstream end of the cartridge compartment (29(1)-29(4)) in terms of the direction, indicated by an arrow mark H (FIG. 17), in which the tray 29 moves when it is pushed into the apparatus main assembly 1A.

The inward portion (a) of each of the first to third intermediary electrical contacts 43-45 is rendered elastic. The inward portions (a) of the first and second intermediary electrical contacts 43 and 44 elastically deform toward the non-driven side, whereas the inward portion (a) of the third intermediary electrical contact 45 elastically deforms in the abovementioned direction H.

The first input electrical contact 39 of each cartridge is on the outward surface of the left end panel 32L of the cartridge. The second input electrical contact 40 is on the outward surface of the lengthwise end wall of the development means container 6*c*, on the non-driven side, and is exposed outward through the window 32*a* with which the left panel 32L is provided.

The third input electrical contact 41 is positioned so that when the cartridge is properly supported by the tray 29, it is at the leading end of the cartridge in terms of the abovementioned tray movement direction H. Further, it is attached to the cartridge so that when the cartridge is properly supported by the tray 29, it is downwardly tilted (FIGS. 12 and 17). Each cartridge is supported by the tray 29 so that the axis a-a of the drum 4 intersects with the abovementioned tray movement direction H. The third input electrical contact 41 is on the outward side of the cartridge in terms of the width direction of the cartridge.

When the cartridge is properly supported in the corresponding cartridge compartment of the tray 29, the first input electrical contact 39 of the cartridge is in contact with the inward portion (a) of the first intermediary electrical contact 43, with the latter kept elastically deformed by the former; the two remain electrically connected. The second input electrical contact 40 of the cartridge is in contact with the inward portion (a) of the second intermediary electrical contact 44, with the latter kept elastically deformed by the former; the two remain electrically connected. The third input electrical contact 41 of the cartridge is in contact with the inward portion (a) of the third intermediary electrical contact 45, with the latter kept elastically deformed by the former; the two remain electrically connected.

The reactive force resulting from the abovementioned elastic deformation of the inward portions (a) of the first and second intermediary electrical contacts 43 and 44 keeps the cartridge in the tray 29 pressed upon the lengthwise end wall of the cartridge compartment, on the driven side, from the non-driven side, enabling thereby the cartridge to precisely receive the driving force transmitted from the apparatus main assembly 1A.

Figure 17:
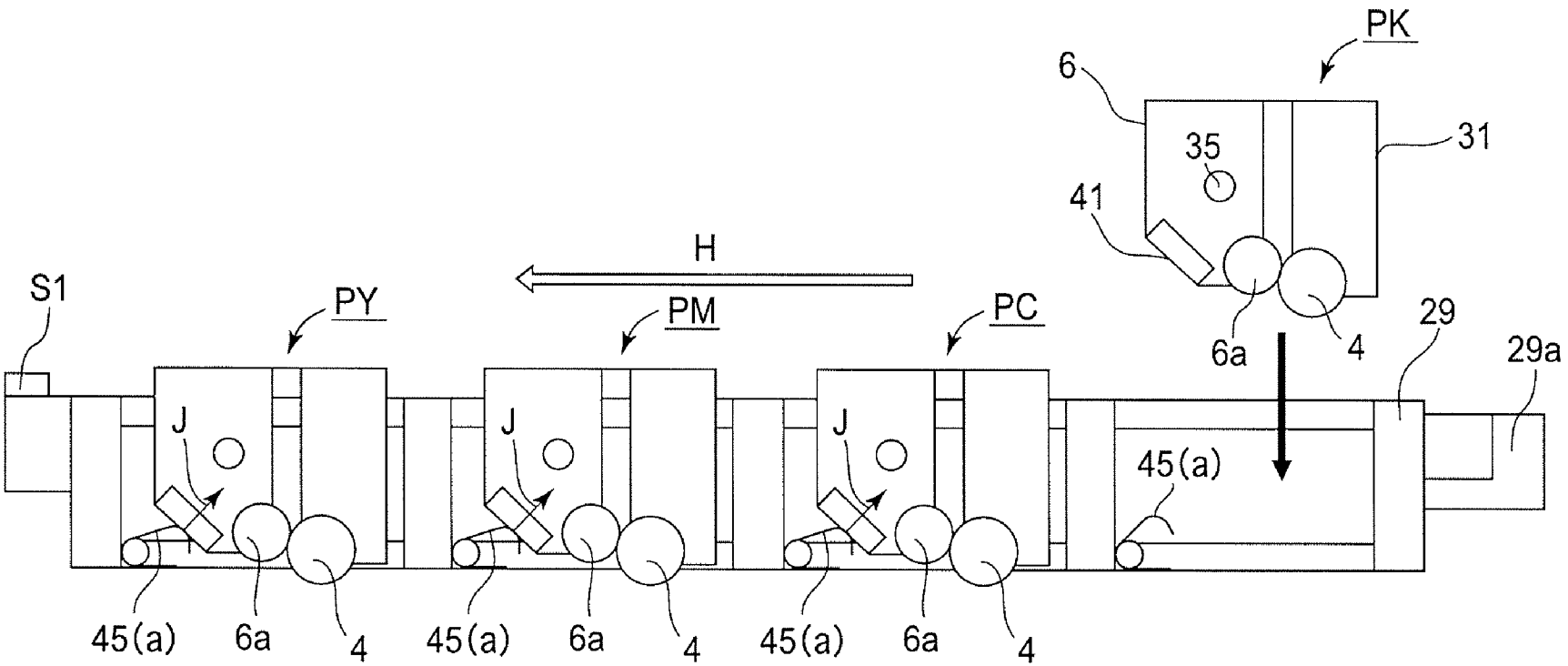
FIG. 17 is a schematic drawing showing the positional relationship between the third intermediary electrical contact of the cartridge tray, and the third input electrical contact of the cartridge.

The third input electrical contact 41 of the cartridge is in contact with the inward portion (a) of the third intermediary electrical contact 45 (FIG. 17). The third input electrical contact 41 is tilted relative to the horizontal plane. Therefore, the third input electrical contact 41 is pressed obliquely upward (direction indicated by arrow mark J in FIG. 21) by the reactive force generated by the elastic deformation of the inward portion (a) of the third internal electrical contact 45. This direction in which the third input electrical contact 41 is pressed is the same as the direction in which force is to be applied to the development unit 6 (second unit of cartridge) to rotate the development unit 6 about the rotational axis b-b of the development unit 6 to place the development roller 6*a* in contact with the drum 4 in the drum unit 31 (first unit of cartridge). This pressure applied to the third input electrical contact 41 by the elasticity of the third intermediary electrical contact 45 presses the cartridge toward the cartridge rotation preventing portion 36L. As a result, the cartridge stabilizes within the range of play afforded between the rotation preventing portion 36L and the surface of the rib 29*i*.

That is, the elasticity of the electrical contact 45 keeps the internal surface of the rotation preventing portion 36L in contact with the rotation preventing rib 29*i*.

In this embodiment, the third input electrical contact 41 contacts the inward portion (a) of the third intermediary electrical contact 45. With the cartridge kept pressed by the elasticity of this inward portion (a), the inward surface of the rotation preventing portion 36L is kept in contact with the cartridge rotation preventing rib 29*i* of the tray 29. The rotation preventing portion 36L is the cartridge rotation preventing contact portion on the cartridge side. The rotation preventing portion 36L, which is the cartridge rotation preventing contact portion on the cartridge side, is on the upstream side of the cartridge in terms of the abovementioned tray movement direction H.

Further, as the third input electrical contact 41 strikes the inward portion (a) of the third intermediary electrical contact 45, the force which upwardly presses the cartridge is generated in the inward portion (a) by the elasticity of the inward portion (a). In other words, the inward portion (a) of the third intermediary electrical contact 45 functions as a shock absorber when the cartridge falls into the corresponding cartridge compartment in the tray 29.

Referring to FIGS. 6 and 7, the operation for replacing the cartridge (cartridges) in the tray 29 with a new cartridge (cartridges) is to be carried out when the tray 29 is in the most outward position relative to the apparatus main assembly 1A. Thus, in order to place the cartridges in the apparatus main assembly 1A, the tray 29 must be moved back into the apparatus main assembly 1A.

If a user moves the tray 29 into the apparatus main assembly 1A too fast, a shock occurs when the tray 29 settles into its home position in the apparatus main assembly. More specifically, the cartridges are shocked as the stopper S1 collides with the solid bumper portion (unshown) of the apparatus main assembly 1A. In this embodiment, however, each cartridge remains stabilized in its cartridge compartment in the tray 29 by the elasticity of the inward portion (a) of the third intermediary electrical contact 45, as described above. That is, the cartridge is supported in its cartridge compartment (29(1)-29(4)), being prevented from moving in the cartridge compartment, in the tray movement direction H. Therefore, even when the tray 29 is subjected to the abovementioned shock, it does not occur that the cartridge substantially move in the tray 29. Therefore, the amount of shock to which the cartridge in this embodiment is subjected when the tray 29 is moved into the apparatus main assembly 1A in this embodiment at an excessive speed is substantially smaller than that to which a cartridge in accordance with the prior art is moved into the apparatus main assembly in accordance with the prior art. In this embodiment, in order to achieve the above described effect, the inward portion (a) of the third intermediary electrical contact 45 is located on the downstream side in terms of the tray movement direction H. Further, the third input electrical contact 41, which comes into contact with the inward portion (a), is located on the downstream side in terms of the tray movement direction H. That is, in this embodiment, the third input electrical contact 41, which is for supplying the supply roller with bias is attached to the leading end of the cartridge in terms of the tray movement direction H. The inward portion (a) of the third intermediary electrical contact 45 is located on the downstream side in the corresponding cartridge compartment (29(1)-29(4)) in terms of the tray movement direction H, and is positioned so that it elastically deforms in the tray movement direction H. In addition, a structural arrangement is made so that as the third input electrical contact 41 is pressed by the elastic inward portion (a) of the electrical contact 45 (intermediary electrical contact), the inward surface of the abovementioned cartridge rotation preventing portion 36L (cartridge rotation preventing portion on cartridge side) comes into contact with the cartridge rotation preventing portion (rib) 29*i* of the tray 29.

Also in this embodiment, the weight of each cartridge was in a range of 500 g-650 g, whereas the amount of elasticity of the intermediary electrical contact 45 was set to a value in a range of 1.5 N-3.5 N (Newtons).

Therefore, it was possible for the cartridge to receive a pressure large enough for the inward surface of the rotation preventing portion 36L (rotation preventing portion on cartridge side) to be placed, and kept, in contact with the cartridge rotation preventing portion 29*i* of the tray 29.

In this embodiment, a torsional coil spring is used as the intermediary electrical contact 45.

The above given numerical values are not intended to limit this embodiment in scope; the cartridge weight and the amount of elasticity of the intermediary electrical contacts are optional.

With the employment of the above described structural arrangement in this embodiment, the amount of impact and vibrations to which the cartridge in this embodiment is subject when the tray 29 in this embodiment strikes the stopper S2 is substantially smaller than the amount of impact and vibrations to which a cartridge in accordance with the prior art is subjected when a tray in accordance with the prior art strikes the stopper S2.

Also in this embodiment, the third input electrical contact 41, which is for supplying bias to the supply roller 6*b* which is located on the downstream side of the charge roller 5 and development roller 6*a* in terms of the abovementioned tray movement direction H, when the cartridge is in the tray 29, is attached to the leading end of the cartridge in terms of the tray movement direction H. Therefore, it was possible to substantially reduce in length the wiring between the third input electrical contact 41 and supply roller 6*b*, compared to the case in which other electrical contacts are attached to the leading end of the cartridge in terms of the tray movement direction H.

Further, in this embodiment, the third input electrical contact 41 is attached to the cartridge so that when the cartridge is in the tray 29, the contact area of the third input electrical contact 41 is downwardly tilted. Therefore, the third input electrical contact 41 is pressed obliquely upward by inward portion (a) of the electrical contact 45. Therefore, the cartridge is pressed obliquely upward from below, ensuring that the inward surface of the cartridge rotation preventing portion 36L (cartridge rotation preventing portion on cartridge side) comes into contact, and kept in contact, with the cartridge rotation preventing portion 29*i*. Moreover, not only do the rotation preventing portion 36L and rotation preventing portion 29*i* function to prevent the cartridge from rotating, but also, they function as shock absorbers.

Further, the play between the cartridge and tray 29 is nullified by the elasticity of the electrical contacts. That is, the cartridge is secured in the tray 29 by the elasticity of the electrical contacts. Thus, even if the user abruptly moves outward the tray 29 in the apparatus main assembly 1A (direction opposite to direction indicated by arrow mark H in FIG. 17), the shock and vibrations to which the cartridge is subjected are substantially smaller than those to which the cartridge in accordance with the prior art is subjected in the same situation.

In this embodiment, the cartridge is provided with the developer leak prevention sheets 6*d* and 7*a*, which are located on the underside of the development roller 6*a* and cleaning blade 7, respectively. However, the reduction in vibrations and shock can further reduce the possibility of developer leak.

In this embodiment, the function of cushioning the shock to which the cartridges are subjected when the tray 29, which can be moved into, or out of, the apparatus main assembly 1A while holding the cartridges, is moved, is assigned to the intermediary electrical contact 45. That is, in this embodiment, the intermediary electrical contact 45 was given the function of supplying electricity, and the function of cushioning shocks. Therefore, not only was it possible to reduce the component count of the image forming apparatus, but also, to simplify the structure of the image forming apparatus.

In the above described embodiment, the electrical contacts and the like are attached to the lengthwise end of the cartridge, on the non-driven side, and the lengthwise end of the tray 29, on the non-driven side. However, this embodiment is not intended to limit the present invention in scope. That is, they may be attached to the lengthwise end of the cartridge, and the lengthwise end of the tray 29, on the driven side.

Also in this embodiment, one of the intermediary electrical contacts is positioned at the leading end of each compartment of the tray 29, in terms of the tray movement direction. However, the positioning of the intermediary electrical contacts does not need to be limited to the one in this embodiment. For example, the intermediary electrical contacts may be positioned at both the leading and trailing ends in terms of the tray movement direction H.

However, positioning one of the intermediary electrical contact at the leading end in terms of the tray movement direction H is more effective to cushion the shock which occurs when the tray 29 is moved into the apparatus main assembly 1A than positioning it at the trailing end. That is, the former arrangement can better cushion the shock to which the cartridge is subjected immediately prior to its usage, being therefore more practical, than the latter arrangement.

<Cartridge Pressing Member>

Next, referring to FIGS. 18-24(*b*), the cartridge pressing member will be described.

Figure 18:
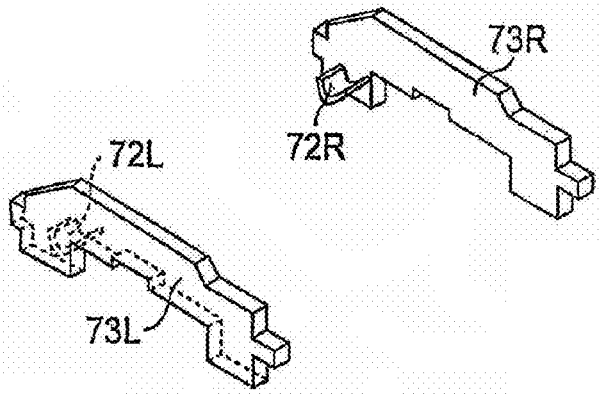
FIG. 18 is a perspective view of the left and right cartridge pressing members and their supporting plates.

The apparatus main assembly 1A is provided with a pair of cartridge pressing members 72L and 72R (left and right members), which are disposed on the front side of the left and right tray holding members 28L and 28R, respectively, and immediately above the path of the tray 29 (that is, cartridge path), opposing each other across the path. The pressing members 72L and 72R are solidly attached to the left and right pressing member supporting plates 73L and 73R, which are solidly attached to the aforementioned left and right tray supporting member 28L and 28R, respectively. FIG. 18 is a perspective view of the left pressing member 72L, the left supporting plate 73L, the right pressing member 72R and the right supporting plate 73R.

The pressing members 72L and 72R are positioned so that when the cartridges PY, PM, PC, and PK held in the tray 29 are moved into the cartridge chamber 1B through the opening 26 of the apparatus main assembly 1A, the pressing members 72L and 72R will be immediately above the paths of the ribs 37L and 37R (cartridge supporting members on cartridge side), respectively. That is, the pressing member 72L is positioned immediately above the path of the rib 72L, and the pressing member 72R is positioned immediately above the path of the rib 72R.

Figure 19:
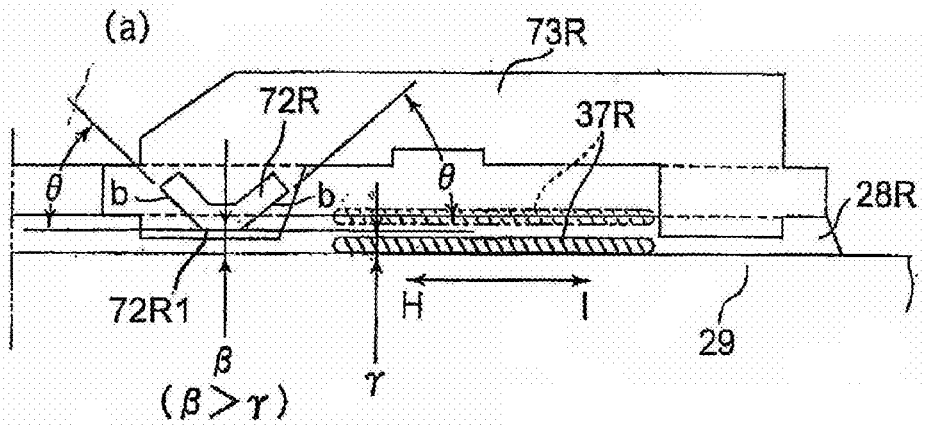
FIG. 19(*a*) is an enlarged side view of the inward side of the left cartridge pressing member and its supporting plate, and FIG. 19(*b*) is an enlarged side view of the inward side of the right cartridge pressing member and its supporting plate.
Figure 19:
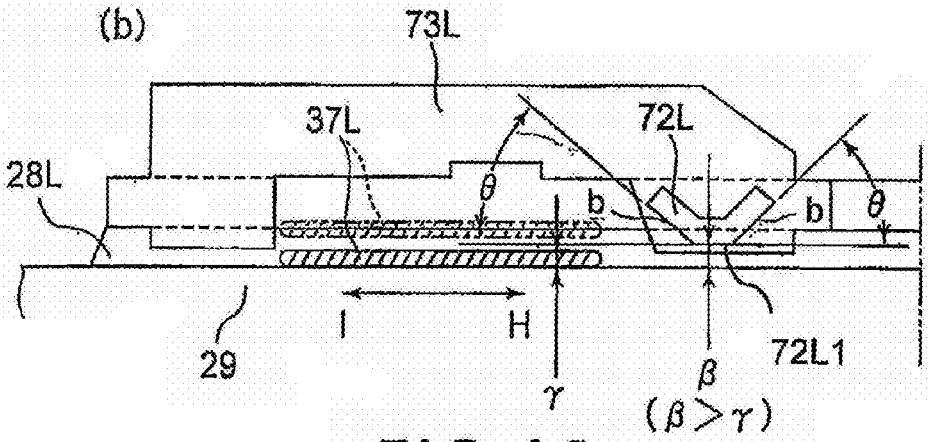

Referring to FIG. 19, each of the pressing members 72L and 72R is disposed so that its bottom portion protrudes into the path of the corresponding rib 37 so that a gap β is provided between the tray 29 and the bottom edge of the pressing member 72. The gap β is greater than the thickness γ of rib 72 (72L and 72R). It is set to a value which ensures that the rib 37 (37L and 37R) of a cartridge in the tray 29, which is upwardly deviant by more than a preset distance, comes into contact with the pressing member 72. The pressing member 72 is provided with slanted surfaces b and b. One surface b (the leftmost slanted surface b in FIG. 19) is on the opening 26 side, and is slanted at an angle θ, in terms of the abovementioned tray movement direction H, whereas the other surface b (the rightmost surface b in FIG. 19) is on the opposite side of the pressing member 72 from the opening 26, and is downwardly slanted at an angle θ, in terms of the direction, indicated by an arrow mark I, in which the tray 29 is pulled out of the apparatus main assembly 1A. When the cartridges are moved into the apparatus main assembly 1A, the upwardly deviant cartridge can be smoothly guided downward by the leftmost slanted surface b in FIG. 19, whereas when the cartridges are moved out of the apparatus main assembly 1A, the upwardly deviant cartridge can be smoothly guided downward by the slanted surface b (the rightmost slanted surface b in FIG. 19).

Figure 20:
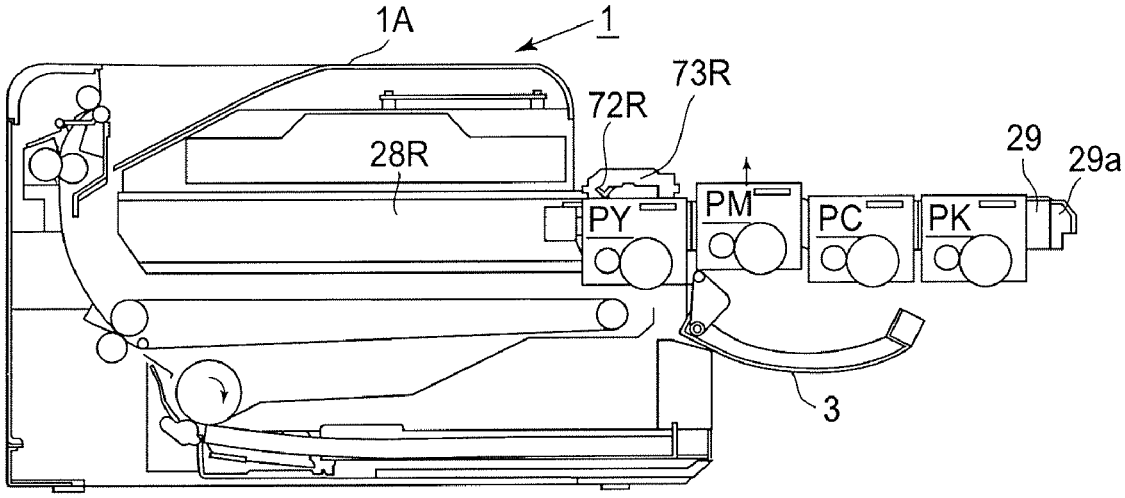
FIG. 20 is a schematic sectional view of the image forming apparatus, the tray of which is in the most outward position, and the second cartridge of which is upwardly deviant from the tray.
Figure 21:
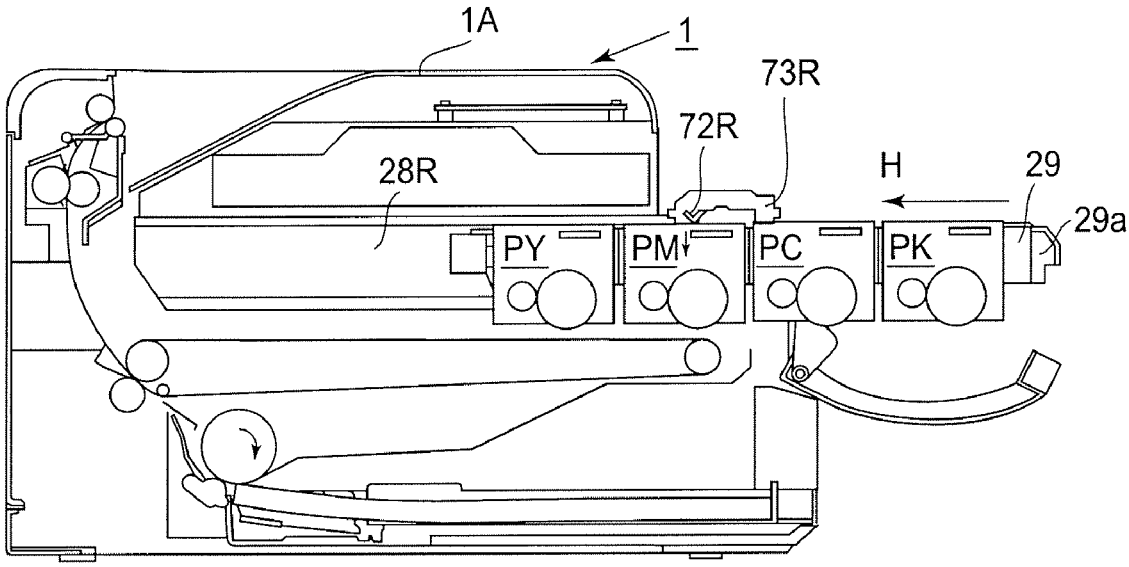
FIG. 21 is a schematic sectional view of the image forming apparatus, the tray of which is being moved back into the main assembly from the position shown in FIG. 20.
Figure 22:
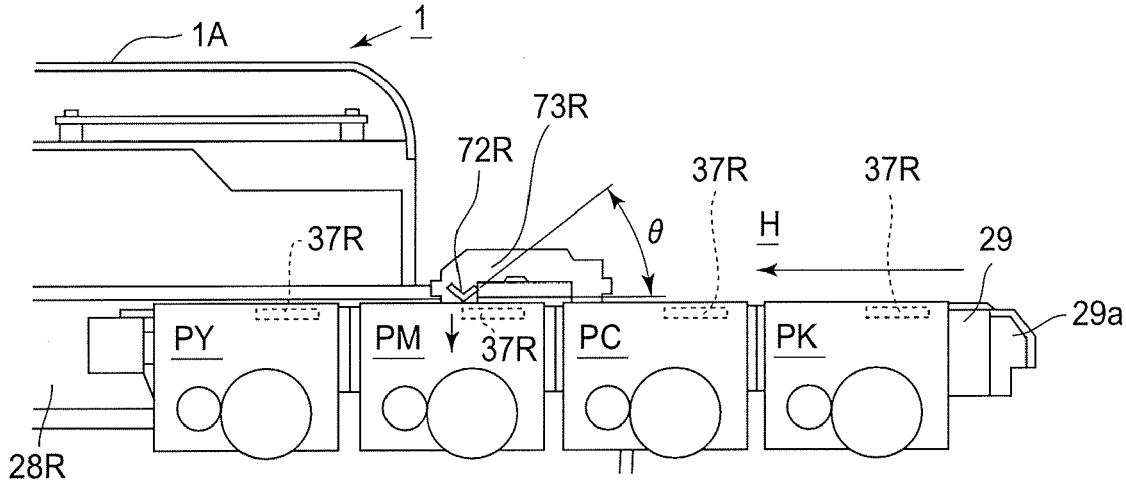
FIG. 22 is an enlargement of the pressing member portion, and its adjacencies, of FIG. 21.

Next, referring to FIGS. 20-22, the functions of the pressing members 72L and 72R will be described. FIG. 20 is a sectional view of the image forming apparatus, the tray of which is in the most outward position, and in which the second cartridge PM is upwardly deviant from the correct position in the tray 29. FIG. 21 is a sectional view of the image forming apparatus, the tray of which is being moved in the abovementioned tray movement direction H from the most outward position shown in FIG. 20. FIG. 22 is an enlargement of the pressing member 72R portion, and its adjacencies, of FIG. 21. The pressing member 72R is provided with the surface b slanted at the angle θ (the rightmost slanted surface b shown in FIG. 18), as described above. If a cartridge, for example, the cartridge PM, in the tray 29 is upwardly deviant from the correct position in the tray 29 when the tray 29 is outside the apparatus main assembly 1A, the rib 37R (cartridge supporting portion on cartridge side) of the cartridge PM comes into contact with the pressing member 72R when the tray 29 is moved into the apparatus main assembly 1A. Thus, as the tray 29 is moved further into the apparatus main assembly 1A, the rib 37R is pressed downward by the slanted surface b of the pressing member 72R (the rightmost slanted surface b shown in FIG. 18). As a result, the flat portion 72R1 of the pressing member 72R comes into contact with the top surface of the rib 37R. The pressing member 72L functions in the same manner as the pressing member 72R functions as described above. That is, the rib 37L of the cartridge PM is pressed downward by the slanted surface b (the rightmost slanted surface b shown in FIG. 19), and then, the flat portion 72L1 of the pressing member 72L comes into contact with the top surface of the rib 37L. Thus, the cartridge PM is moved into the correct position in the tray 29. That is, the ribs 37R and 37L are supported by the top surface of the tray 29.

As described above, while the tray 29 is moved into the apparatus main assembly 1A, the pressing members 72L and 72R press down the upwardly deviant cartridge (cartridges) in the tray 29, moving thereby the cartridge (cartridges) into the correct position in the tray. Further, as the ribs 37L and 37R move through the gap between the pressing members 72L and 72R and the tray 29, the cartridge (cartridges) is pressed into the normal position in the tray 29.

When the tray 29 is pulled out of the apparatus main assembly 1A, the slanted surface b (the leftmost slanted surface b shown in FIG. 18 and the rightmost slanted surface b shown in FIG. 19), instead of the other slanted surface b (the rightmost slanted surface b shown in FIG. 18 and the leftmost slanted surface b shown in FIG. 19), presses the ribs 37R and 37L downward.

With the presence of the slanted surface b (the rightmost slanted surface b shown in FIG. 18), the cartridge can be smoothly guided downward when the tray (cartridges) is moved into the apparatus main assembly 1A. The slanted surface b (the leftmost slanted surface b shown in FIG. 18) makes it possible to smoothly guide the cartridge downward when the tray 29 (cartridges) are moved out of the apparatus main assembly 1A.

The height of the pressing members 72L and 72R, and the angle of the slanted surfaces b and b in this embodiment, are optional.

Figure 23:
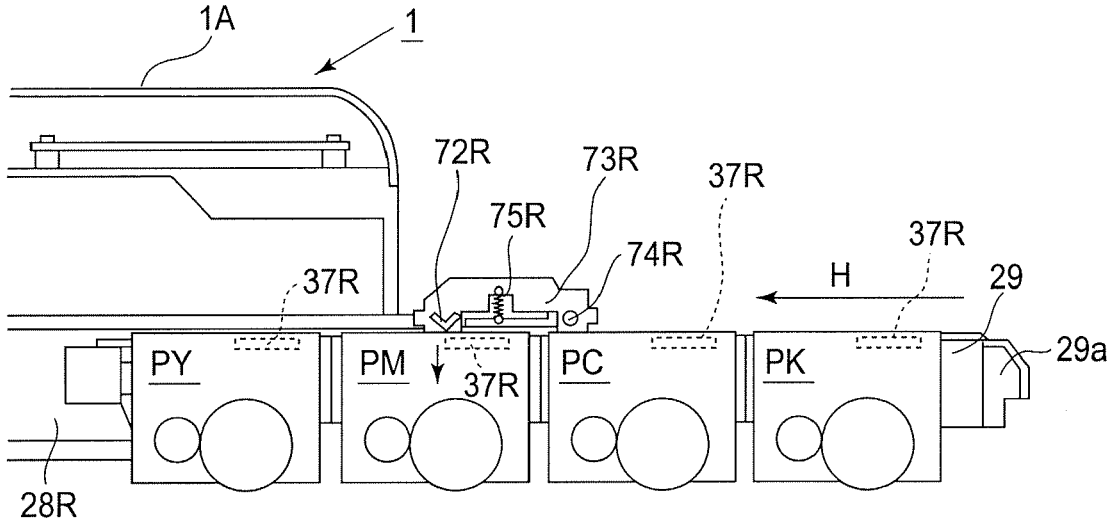
FIG. 23 is a sectional view of the more effective version of the cartridge pressing member supporting member in the preferred embodiment of the present invention, and its adjacencies.
Figure 24:
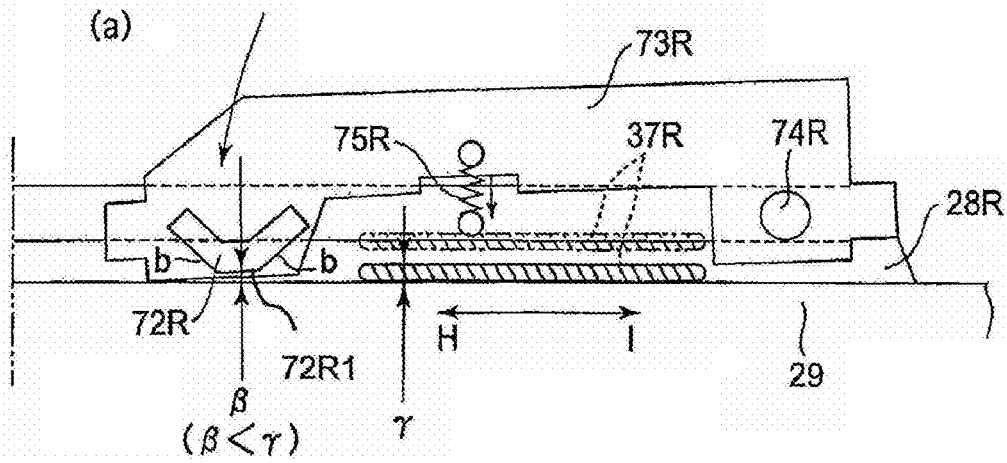
FIG. 24(*a*) is an enlarged side view of the inward side of the more effective version of the left cartridge pressing member supporting member in the preferred embodiment, shown in FIG. 23, and FIG. 24(*b*) is an enlarged side view of the inward side of the more effective version of the right cartridge pressing member supporting member.
Figure 24:
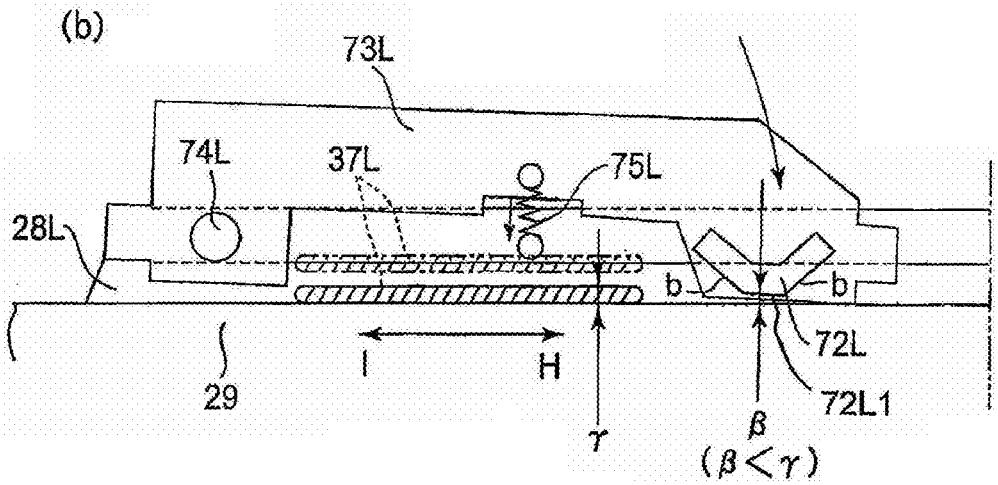

FIGS. 23, 24(*a*) and 24(*b*) are drawings of more effective versions of pressing members 72L and 72R. The pressing members 72L and 72R have supporting plates 73L and 73R, which are rotatable relative to the left and right tray supporting members 28L and 28R, about fulcrums 74L and 74R, respectively. Further, the supporting plates 73L and 73R are kept pressured by tensional springs 75L and 75R, respectively, in the direction to rotate toward the tray 29. This structural arrangement, that is, the presence of elastic members (tensional springs 75L and 75R), ensures that the ribs 37L and 37R of each cartridge are pressed downward by the pressing members 72L and 72R. Further, the elasticity of the tensional springs 75L and 75R can soften the shock which occurs as the ribs 37L and 37R collide with the pressing members 72L and 72R. In other words, this structural arrangement improves the image forming apparatus in the operability of the tray 29 by a user.

In the embodiment described above, the image forming apparatus 1 is structured so that the pressing members 72L and 72R come into contact with the ribs 37L and 37R, respectively, of the cartridge (cartridges) in the tray 29, which is upwardly deviant from the correct position in the tray 29. However, this embodiment is not intended to limit the presence invention in scope. For example, the image forming apparatus 1 may be structured as shown in FIGS. 23, 24(*a*) and 24(*b*).

In the case of the structural arrangement shown in FIGS. 23, 24(*a*) and 24(*b*), the pressing members 72L and 72R come into contact with the top surfaces of all the cartridges which are moved by being supported by the tray 29. Further, they elastically presses the cartridges toward the tray 29 which supports the cartridges. This structural arrangement achieves effects similar to those achieved by the above described preferred embodiment.

The number of pressing members may be one; the image forming apparatus may be provided with only one of the pressing members 72L or 72R. However, providing the apparatus with both the pressing members 72L and 72R is more effective.

As described above, in this embodiment, the pressing members 72L and 72R are positioned in the top portion of the path through which the cartridges are moved into the cartridge chamber 1B through the opening 26 while being supported by the tray 29 (movable member), so that the when the cartridges are moved below the pressing members 72L and 72R, the pressing members 72L and 72R come into contact with the cartridges, and press the cartridges toward the tray 29 by which the cartridges are supported. Therefore, it is possible to prevent the problem that when multiple cartridges are moved into the apparatus main assembly 1A while being supported by the movable member, they accidentally collides with the other internal structural components of the apparatus main assembly 1A; it is possible to smoothly move the cartridges into the apparatus main assembly 1A. Further, placing the pressing members 72L and 72R in the top portion of the tray path makes it possible to use a single pair of pressing members, that is, the pressing members 72L and 72R, as the common pressing members, to elastically press all the multiple cartridges which are moved below the pressing members.

Further, the image forming apparatus 1 may be structured so that the pressing members 72L and 72R contact the top surfaces of all the cartridges which move below the pressing members, and elastically press all the cartridge toward the tray 29 by which they are supported. This arrangement ensures that the multiple process cartridges are more smoothly moved into the main assembly of the electrophotographic color image forming apparatus.

Also in the embodiment described above, when multiple cartridges supported by the tray 29 are moved below the pressing members 72L and 72R, the pressing members 72L and 72R come into contact with the cartridge (cartridges) which is upwardly deviant from the tray 29 by a distance greater than a value which allows the pressing members 72L and 72R to contact the cartridge, and press the upwardly deviant cartridge toward the top surface of the tray 29, by which the cartridges are to be supported. Therefore, the cartridge(s) which is upwardly deviant from the correct cartridge position in the tray 29 is moved into the correct cartridge position in the tray 29. That is, even if the cartridge(s) in the tray 29 is upwardly deviant from the correct cartridge position in the tray 29, it is moved into the correct cartridge position in the tray 29 by the pressing member 72L and 72R.

Also in the embodiment described above, the pressing members 72L and 72R are positioned at opposing ends of the apparatus main assembly 1A in terms of the direction perpendicular to the direction in which the cartridge(s) is moved through its path. Therefore, the pressing members 72L and 72R contact the opposing ends of the cartridge(s), in terms of the direction perpendicular to the cartridge movement direction, when the cartridge(s) moves below the pressing members 72L and 72R. Therefore, it is ensured that multiple cartridges are smoothly moved into the apparatus main assembly 1A.

The number of pressing members may be only one. That is, in terms of the direction perpendicular to the direction in which the cartridge(s) moves through the cartridge path, it may be at only one end of the apparatus main assembly 1A that the pressing member is provided; it may be either the pressing member 72L or 72R. This arrangement can reduce component count of the image forming apparatus, and therefore, can reduce the cost of the apparatus.

Further, the pressing members 72L and 72R are solidly attached to the apparatus main assembly 1A so that they protrude downward into the cartridge path. Each pressing member 72 has the slanted surface b (the rightmost slanted surface b shown in FIG. 18 and the leftmost slanted surface b shown in FIG. 19), which is on the opening 26 side of the pressing member 72, and is downwardly slanted in terms of the downstream direction, that is, the direction in which the tray 29 is moved into the apparatus main assembly 1A (direction H in FIGS. 19(*a*) and (*b*)). Therefore, when multiple cartridges are moved into the apparatus main assembly 1A while being supported by the movable member, they can be smoothly moved into the apparatus main assembly 1A.

Further, each pressing member 72 has the slanted surface b (the leftmost slanted surface b shown in FIG. 18 and the rightmost slanted surface b shown in FIG. 19), which is on the opposite side of the pressing member 72 from the opening 26 and is downwardly slanted in terms of the direction (direction I in FIGS. 19(*a*) and (*b*); downstream direction) in which the tray 29 is moved out of the apparatus main assembly 1A.

Further, the pressing members 72L and 72R may be kept downwardly pressured by elastic pressing means to ensure that the multiple cartridges are more smoothly moved into the apparatus main assembly 1A.

The pressing members 72L and 72R are disposed next to the opening 26.

In the embodiment described above, the image forming apparatus was structured so that the pressing members 72L and 72R downwardly press the ribs 37L and 37R. However, the above described embodiment is not intended to limit the present invention in scope. For example, the image forming apparatus may be structured so that the pressing members 72L and 72R press the top surface of the cartridge, or the center portion of the top surface of the cartridge.

Also in the embodiment described above, the tray 29 was movable in a straight line in the direction parallel to the surface on which the apparatus main assembly 1A is set. However, the embodiment is not intended to limit the present invention in scope. For example, the image forming apparatus may be structured so that the tray 29 is movable in a straight line in the obliquely upward direction, or obliquely downward direction, relative to the surface on which the apparatus main assembly 1A is set.

According to an aspect of the present invention, there is provided an electrophotographic color image forming apparatus which is characterized in that multiple process cartridges can be smoothly inserted into the main assembly of the apparatus.

According to another aspect of the present invention, there is provided an electrophotographic color image forming apparatus which is characterized in that it is superior in operability to an electrophotographic color image forming apparatus in accordance with the prior art, in terms of the insertion of multiple process cartridges into the apparatus main assembly.

According to a further aspect of the present invention, there is provided an electrophotographic color image forming apparatus which is characterized in that when multiple cartridges are inserted into the apparatus main assembly, while being held by the movable member, the cartridges do not accidentally collide with the other structural components in the apparatus main assembly.

According to the present invention, it is possible to provide an electrophotographic color image forming apparatus which is characterized in that even if a cartridge in the cartridge-holding movable member is upwardly deviant from the correct cartridge position in the cartridge-holding movable member, the cartridge can be moved into the correct cartridge position in the cartridge-holding movable member by a pressing member.

According to a yet further aspect of the present invention, there is provided an electrophotographic color image forming apparatus which is characterized in that the apparatus main assembly is provided with a pressing member which is positioned in the top portion of the path of the abovementioned cartridge-holding movable member, and therefore, multiple cartridges can be elastically pressed one by one by a single pressing member (common pressing member) when the cartridges move below the pressing member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 355652/2006 filed Dec. 28, 2006 which is hereby incorporated by reference.

What is claimed is:

1. A color electrophotographic image forming apparatus having a main assembly, to which a process cartridge is detachably mountable, for forming a color image on a recording material, wherein the process cartridge includes an electrophotographic photosensitive drum and process means actable on the electrophotographic photosensitive drum, said apparatus comprising:

an opening provided in said main assembly of the apparatus;

a movable member which is linearly movable between an inside and an outside of said opening in a direction crossing with a longitudinal direction of the electrophotographic photosensitive drum while carrying a plurality of such process cartridges;

an accommodating portion for accommodating the process cartridges; and an urging member, provided above a movement path of the process cartridges, while being carried on said movable member, from said opening to said accommodating portion, for contacting the process cartridge passing therebelow to urge the process cartridge toward said movable member.

2. An apparatus according to claim 1, wherein said urging member contacts all of the process cartridges passing therebelow to urge elastically the process cartridge toward said movable member.

3. An apparatus according to claim 1, wherein said urging member contacts such a process cartridge as is deviated upwardly to a degree enough to contact to said urging member.

4. An apparatus according to any one of claims 1-3, wherein said urging member is provided at each of lateral ends with respect to the movement path to contact the process cartridge at each of longitudinal end portions of the process cartridge.

5. An apparatus according to any one of claims 1-3, wherein said urging member is provided at one of lateral ends with respect to the movement path to contact the process cartridge at one of longitudinal end portions of the process cartridge.

6. An apparatus according to claim 1, 2, or 3, wherein the process cartridge is supported by a portion of said movable member which is contacted by said urging member.

7. An apparatus according to claim 1, 2, or 3, wherein said urging member is fixed and projected downwardly from said main assembly of the apparatus and is provided at an opening side with an inclined surface lowering from an upstream to a downstream with respect to a moving direction of said movable member from the outside to the inside.

8. An apparatus according to claim 7, wherein said urging member is provided at a side remote from said opening with an inclined surface lowering from an upstream to a downstream with respect to a moving direction of said movable member from the inside to the outside.

9. An apparatus according to claim 1, 2, or 3, wherein said urging member is urged downwardly by an elastic force.

10. An apparatus according to claim 1, 2, or 3, wherein said urging member is in said opening.

11. An apparatus according to claim 1, 2, or 3, wherein said movable member carries a process cartridge containing a black color developer, a process cartridge containing a cyan color developer, a process cartridge containing a magenta color developer and a process cartridge containing a yellow color developer in the order named from an upstream to a downstream with respect to a moving direction of said movable member from the outside to the inside.

* * * * *